United States Patent [19]

Rabl

[11] 3,997,779

[45] Dec. 14, 1976

[54] CIRCUIT DEVICE FOR SECONDARY ELECTRON MULTIPLIERS

[75] Inventor: Carl-Roland Rabl, Gottingen, Germany

[73] Assignee: Max-Planck-Gesellschaft zur Forderung der Wissenschaften e.V., Gottingen, Germany

[22] Filed: Oct. 24, 1974

[21] Appl. No.: 517,844

[30] Foreign Application Priority Data

Oct. 25, 1973 Germany ..... 2353573

[52] U.S. Cl. ..... 250/207; 313/105 R; 328/243

[51] Int. Cl.[2] ..... H01J 39/12

[58] Field of Search ..... 250/207, 214; 328/242, 328/243; 313/94, 104, 105

[56] References Cited

UNITED STATES PATENTS

| | | | |
|---|---|---|---|
| 2,458,539 | 1/1949 | Soller | 328/243 |
| 3,080,790 | 3/1963 | Morgan | 313/105 |
| 3,393,319 | 7/1968 | Randall et al. | 250/207 |

*Primary Examiner*—David C. Nelms
*Attorney, Agent, or Firm*—Flynn & Frishauf

[57] ABSTRACT

A circuit device for electron multipliers, especially photomultiplier tubes, in which the amplification is varied by switching the number of active dynodes. Sensitivity ranges from diode-mode up to a multiplier with full number of dynodes. The signal is taken from the last active dynode, and from the cathode in diode-mode. Any switchable dynode is provided with its own load resistor inserted between the relevant dynode and a dynode voltage divider. An amplifier connected to the last active dynode and to the dynode voltage divider provides a feedback that compensates for voltage drops at the next lower dynodes due to the finite impedance of the dynode voltage divider. The circuit device features fast signal risetime, high linearity and wide dynamic signal range together with high DC-current capability and clean transient response. Applications are transient-spectrophotometers where high signal-to-noise ratios are needed, accurate pulse-height-analysis, etc. The device may be constructed as a self-contained unit.

36 Claims, 20 Drawing Figures

Fig. 14 a) b) c)
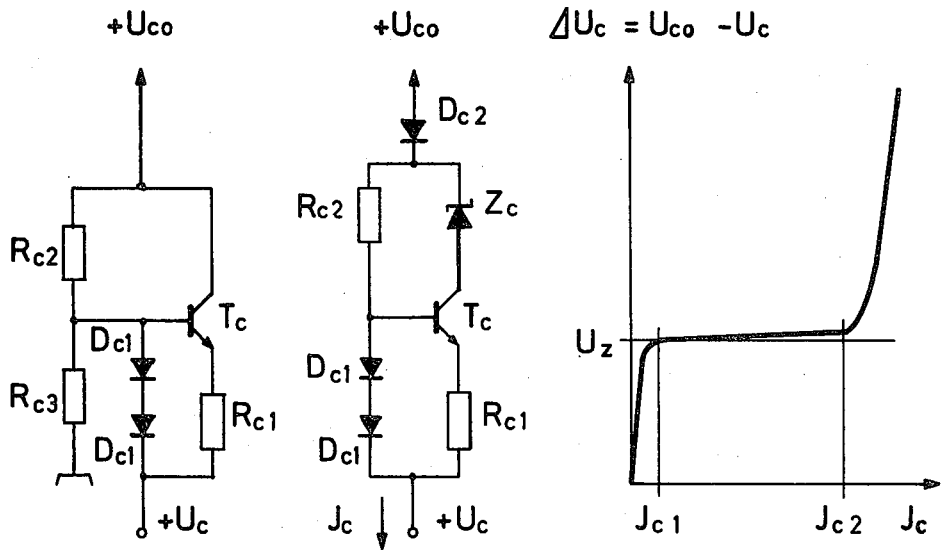
Fig. 14d)
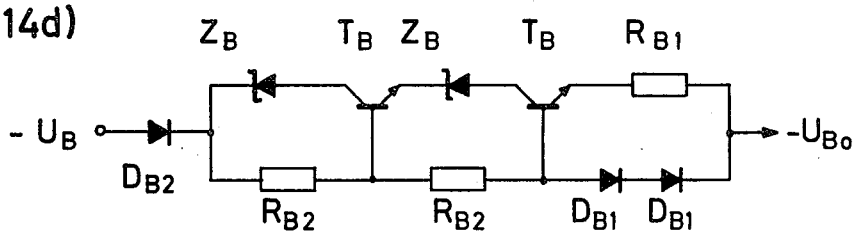
Fig. 15
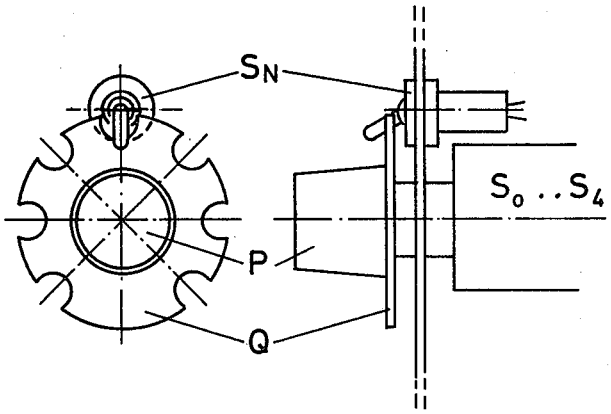

CIRCUIT DEVICE FOR SECONDARY ELECTRON MULTIPLIERS

BACKGROUND OF THE INVENTION

The present invention relates to a circuit device for electron multipliers, especially for photomultipliers, which allows the measurement of high light intensities with high linearity, short risetimes and optimal signal-to-noise ratios.

The signal-to-noise ratio for the output of a photomultiplier is given by the equation $$S/N = \sqrt{I_k/2\alpha e\Delta f} = \sqrt{2\tau_D I_k/\alpha e} \quad (1)$$

where:

$I_k$ = cathode current in [A],
$e = 1.6 \cdot 10^{-19}$ [A sec]
$\alpha$ = power noise factor
$\Delta f$ = power bandwidth
$\tau^D$ = detector risetime constant, referred to as "risetime"

Because of the short signal risetimes $\tau_D$ involved, processes which take place in the $\mu$sec and nsec range can only be investigated with satisfactory signal-to-noise ratios if high cathode currents are used. This is especially true when an average value cannot be obtained from a large number of individual measurements. A typical example of such an application is the optical investigation of fast chemical reactions by a method such as temperature-jump relaxation. In this case the signal-to-noise ratio for a risetime of, say 0.3 $\mu$sec, should be of the order of $10^4$, corresponding to cathode currents of up to 100 $\mu$A or more. A very high linearity and a frequency response which is constant almost up to the cut-off frequency are required. The transient response must be characterized by fast settling and must be free from any instability and drifting effects in the long time range.

High cathode currents with good linearity can be obtained by using semiconductor and vacuum photodiodes. However, difficulties arise from the fact that one often has to work at much lower light intensities, too. In the case of monochromatic measurements in the visible and ultraviolet spectral ranges the maximal possible cathode currents can vary by a factor of 1000 or more. The use of photodiodes would then require either very high load resistances, leading to a long signal risetime $\tau_D$, or, if small load resistances are used, large electronic postamplification. In the latter case the thermal noise of the load resistance, the amplifier noise, and the drifting or the amplifier would cause an inadmissible deterioration of the measuring signal.

Conventional photomultiplier circuits in which the cathode current is amplified by a large number of dynode stages are also unsuitable for the purpose mentioned. In continuous operation, only currents of the order of 100 $\mu$A are permissible at the anode. At an amplification of $10^5$ this would correspond to a cathode current of only 1 nA. If, however, the amplification is reduced by decreasing the dynode voltage, linearity and noise performance will deteriorate, whereas excessively high currents will lead to drifting and fatigue.

A known technique for reducing the amplification of a photomultiplier is to decrease the number of active dynodes by connecting several dynodes in parallel with the anode. As a consequence, the range in which the amplification can be controlled by changing the dynode voltage is considerably limited. Changing the amplification by other means leads to the same difficulties as encountered with photodiodes.

Furthermore, there are circuits known by which the number of active dynodes can be changed allowing the use of a constant load resistance. For the electronic postamplification only a gain interval corresponding to the gain factor per stage v of the photomultiplier has to be covered (e.g. $v = 4 \ldots 5$). The switching of the dynodes is usually done by purely mechanical switching of the photomultiplier connections with the dynode resistor chain and the signal output. This, however, requires a large number of coupled switches if a large number of dynodes is to be switched and becomes quite cumbersome. At the same time the stray capacitances and, consequently, the signal risetime $\tau_D$ will increase.

Another known circuit device uses switching diodes which are series-connected with the dynode chain resistors. In principal, only two coupled switches are needed in this circuit; one for selecting one dynode as the effective anode, and another one for connecting the corresponding point of the dynode resistor chain to ground. The switching diodes disconnect the effective anode and all higher dynodes from the dynode resistor chain. However, the diodes must have a good small-signal behaviour, especially low capacitances. Thus they may be easily destroyed when switching the high dynode potentials. At the same time, the potential of the unused higher dynodes becomes freely variable, leading to interference with the active part of the phototube and deteriorating linearity and frequency response. Furthermore, the circuit involves serious difficulties in paralleling capacitors to the dynode resistor chain in order to improve the high frequency response. Without such capacitors a very high current drain is needed for short risetimes.

OBJECTS AND SUMMARY OF THE INVENTION

It is therefore an object of the invention to vary the amplification of a secondary electron multiplier by switching the number of active dynodes without needing too many mechanical switches even if a large number of dynodes is to be switched. Signal diodes which are series-connected with dynode chain resistors should be avoided. Most important are high linearity, a high dynamic signal range, and short signal risetimes together with a clean transient response. It is also an object of the invention to need a low power drain in the dynode voltage divider and to provide a low impedance output which both favour the compartmentalization of the total circuit device in an electron multiplier housing that can be installed in experimental set-ups as an individual unit and connected to a signal processing unit and to the power supply lines by a multi-lead cable.

With the new circuit device described herein, each switchable dynode is provided with its own load resistor which is inserted between the dynode and a dynode voltage divider which consists of ohmic dynode chain resistors and, for improved performance, also of capacitances and impedances such as Zener diodes. The signal is taken from the last active dynode to the input of an operational amplifier, which is used as a current-to-voltage transducer. The output signal is fed back to the dynode voltage divider. The next higher dynodes and the multiplier anode are connected to a positive drain voltage. The ratio of the value of the dynode chain resistors to the value of said load resistors should be equal to or somewhat smaller than the gain factor per stage of the multiplier tube which results in a voltage feedback which compensates for the voltage drop in the dynode voltage divider due to the dynode current drain at the lower dynodes. Thus improved linearity and low power demand are obtained. For switching, three mechanically coupled switches are sufficient. Diodes may be used for easier switching which are in parallel to the dynode chain resistors and are not critical. A fourth switch and switchable resistors may be provided at the negative terminal of the dynode voltage divider in order to operate the circuit with a constant negative high voltage. The circuit exhibits low stray capacitances and thus, for a given load resistance, a short signal risetime. Excellent performance has been obtained. By introducing smaller auxiliary load resistors and capacitors the signal risetime can be considerably reduced.

BRIEF DESCRIPTION OF THE DRAWINGS

The present invention will be better understood, and objects and advantages will become more apparent, from the ensuing detailed specification of preferred, although exemplary, embodiments of the invention taken in conjunction with drawings, where:

FIGS. 14*a*–14*d*: Protective circuits used with the power supply lines.

FIG. 15: Mechanical locking device for the dynode switching element.

In all figures corresponding circuit elements have been denoted with the same symbols. Circuit elements which are related to the dynodes have been denoted with double-indexed symbols where the second subscript denotes the number of the dynode stage (e.g., $R_{b1}$, $R_{b2}$, . . . = dynode chain resistors of the first, the second, etc., dynode stage). These elements will have identical values normally. The same symbol without the second subscript denotes the group of these circuit elements and their electrical value in the equations (e.g., $R_b = R_{b1} = R_{b2} = R_{b3} = \ldots$, etc., unless otherwise specified).

Figure 1:
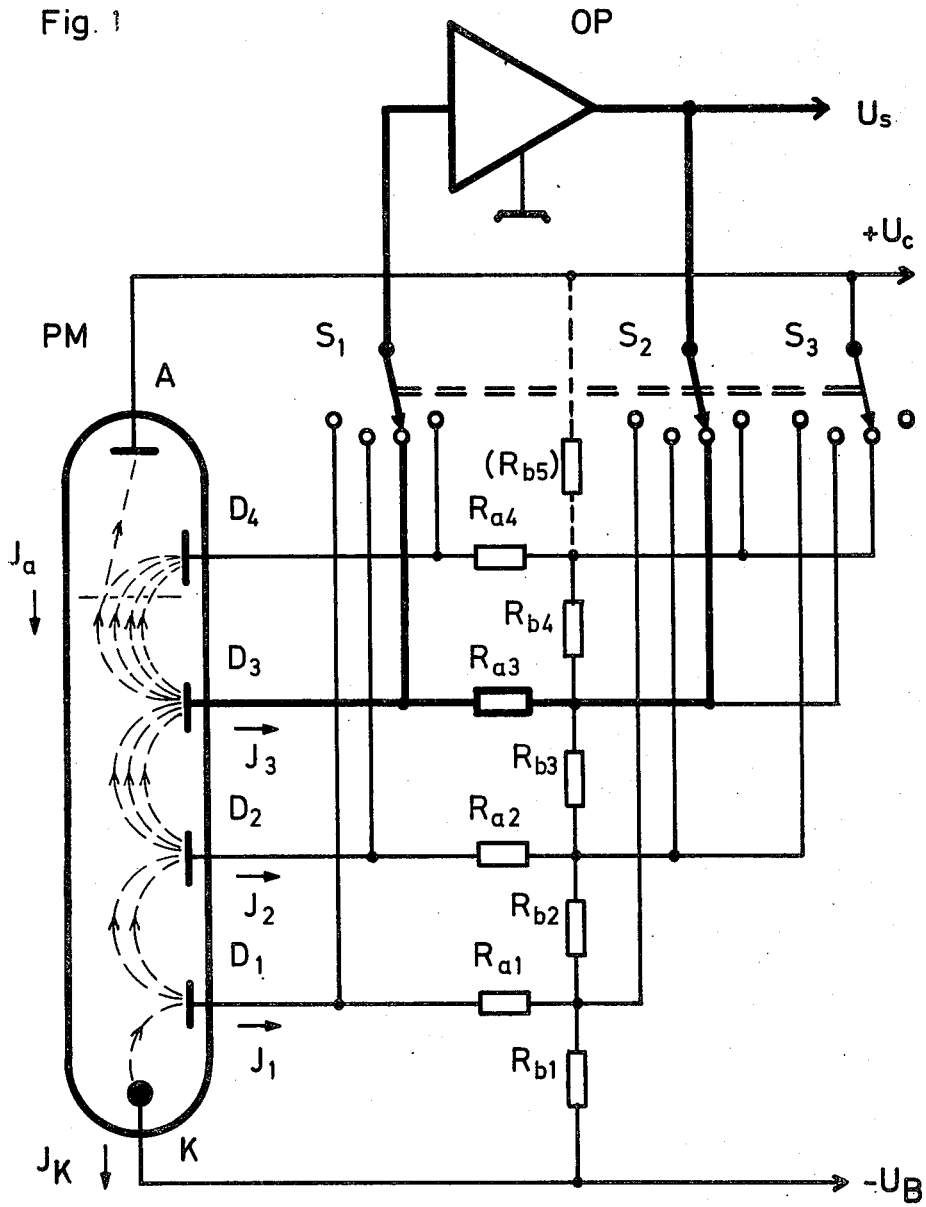
FIG. 1 is a principle circuit diagram of a secondary electron multiplier with dynode-switching circuit according to the invention.

FIG. 1 shows a simplified circuit diagram explaining the principle idea of the invention. PM is a multiplier tube, especially a photomultiplier, with a cathode K, 4 dynodes $D_1$ to $D_4$ and an anode A. The dynode resistor chain is formed by resistors $R_{b1}$ through $R_{b4}$ of equal values $R_b$, and is connected to a negative supply voltage $-U_B$ at its cathode end. The output signal is taken from the last dynode instead of the anode, which is known as an alternative in multiplier circuits. In order to achieve this with a switchable circuit device and to obtain a minimum number of "hot signal" contacts and thus low stray capacitances, load resistors $R_{a1}$ through $R_{a4}$ of equal values $R_a$ are inserted between the dynodes and the dynode resistor chain. The latter ones are connected to a multiple switching device consisting of mechanically coupled switches $S_1$, $S_2$ and $S_3$ with four positions corresponding to 1 to 4 active dynodes. The load resistor or the selected last active dynode (e.g. $R_{a3}$ at $D_3$) is connected with the input and the output of an operational amplifier OP by the switches $S_1$ and $S_2$, respectively. The next highest dynode (e.g. $D_4$) acts effectively as an anode and is connected to a positive drain voltage $+U_c$ via the switch $S_3$. At the highest dynode position only the anode A is connected to the drain voltage $+U_c$. When the dynodes are switched the anode can be left connected with this voltage. For reasons of symmetry a resistor $R_{b5} = R_b$ (drawn with a dotted line) can be inserted between $+U_c$ and the upper end of the dynode resistor chain.

The switching position shown in FIG. 1 corresponds to the sensitivity position of 3 active dynodes. The amplification of the cathode current $I_k$ at the dynodes $D_1$ to $D_3$ has been represented schematically by indicating the electron paths as thin dotted lines where the arrows represent the direction of the electron flow which is opposite to that of the current as conventionally defined. If the gain factor per stage is $v$, the effective anode current is $I_a = v^3 \cdot I_k$. The current at the third dynode is given by $$I_3 = (v-1)/(v) \cdot I_a = v^2(v-1) \cdot I_k \qquad (2)$$

The operational amplifier OP, together with the load resistor $R_{a3}$ of the dynode $D_3$ (drawn with a bold line), is working as a current-to-voltage transducer. The potential of this dynode is kept constant, whereas the signal output voltage of the operational amplifier is $$U_s = -I_3 \cdot R_{a3}$$

The ratio of the ohmic dynode chain resistors $R_{b1}$, . . , $R_{b4} = R_b$ to th ohmic load resistors $R_{a1}$, . . , $R_{a4} = R_a$ should be chosen to be either approximately equal to or somewhat smaller than the stage gain v of the photomultiplier. In this case a voltage feedback is obtained via the dynode resistor chain which compensates for the voltage changes at the preceding dynodes $D_2$ and $D_1$ due to the finite dynode currents $I_2$ and $I_1$.

Figure 2:
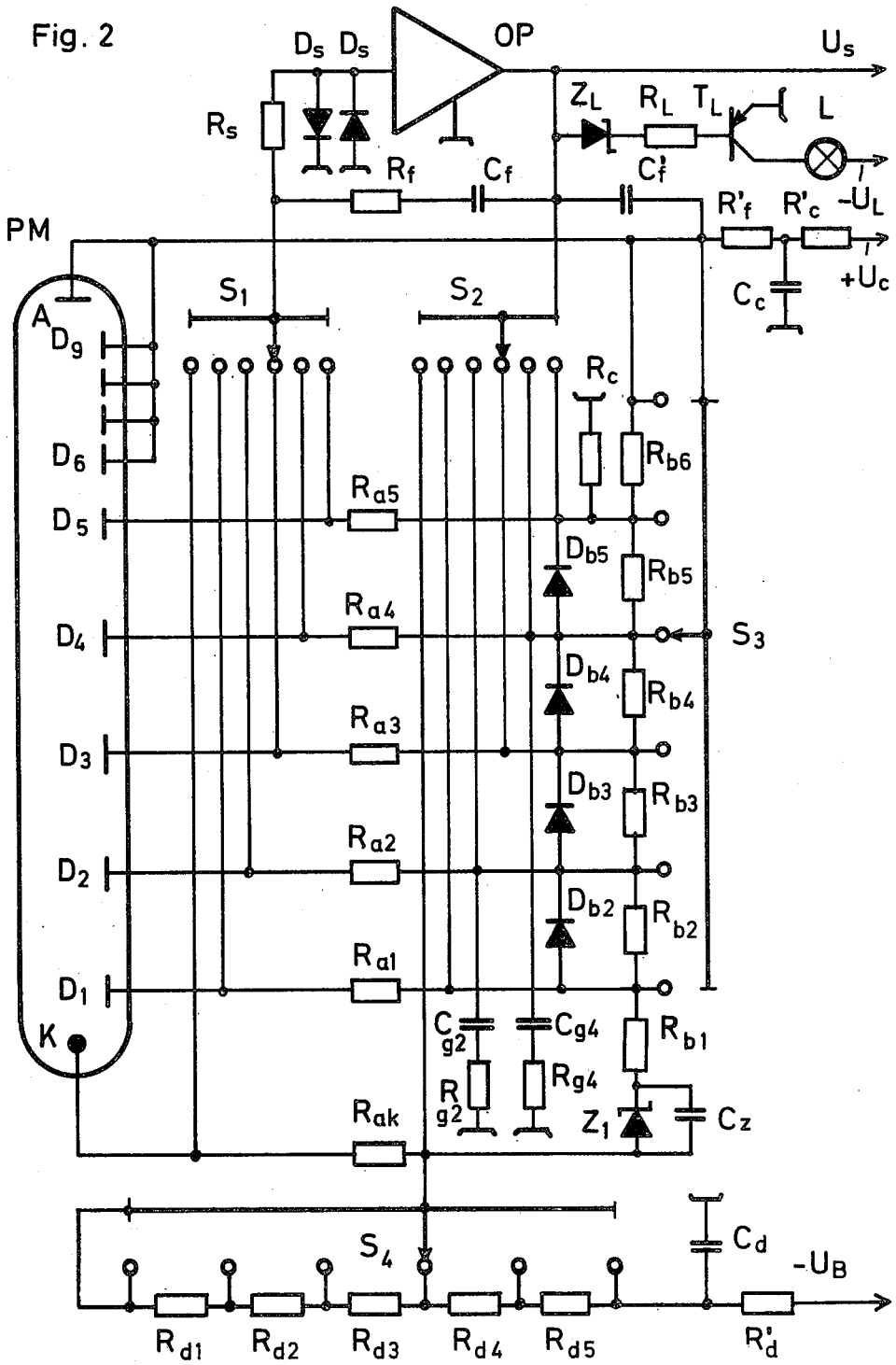
FIG. 2 is an example of a circuit device especially designed for side-on photomultipliers. Switching is possible as a photodiode or as photomultiplier with 1 to 5 active dynodes.

In the following equations the number of equal resistors of the value $R_b$ between the output of the operational amplifier and the negative supply voltage $-U_B$ is denoted by $n$, (For the switch positions shown in FIG. 1 is $n = 3$, and for those shown in FIG. 2 is $n = 5$ where $R_{d1}, \ldots, R_{d5} = R_b$.) The voltage change $\Delta U_2$ at the second dynode is thus described by $$\Delta U_2 = I_k \cdot \frac{n-3}{n} R_b + I_1 \cdot \frac{n-2}{n} R_b + I_2 \cdot \left( (R_a + \frac{n-1}{n} R_b \right) - I_3 \cdot \frac{n-1}{n} R_a \quad (4)$$

With $$I_3 = v \cdot I_2 = v^2 \cdot I_1 = v^2(v-1) \cdot I_k \quad (5)$$

one obtains:

$$\Delta U_2 = \frac{1}{n} I_2 \cdot (nv - v - n + v^{-2}) \cdot \frac{v}{(v-1)^2} R_b - (nv - v - n) R_a \quad (4a)$$

If $$R_b/R_a = (v-1)^2/v \quad (6)$$

it follows that $\Delta U_2 = 0$ except for an error which is given by $U_s/n.v^3$. The same holds for the voltage change $\Delta U_1$ at the first dynode.

If the described voltage feedback would be omitted and the circuit elements would have the same values the voltage changes would be of the order of magnitude of $U_s$. In FIG. 1 the voltage $-U_B$ at the cathode K is kept constant by the negative voltage supply. In FIG. 2, however, further resistors $R_d$ of the order of $R_b$ are inserted between the cathode and the voltage supply. In this case the voltage at the cathode can be kept constant by choosing appropriate values which will be discussed in connection with FIG. 2. Although insertion of the load resistances $R_a$ facilitates the switching procedure, it causes effectively an increase of the source resistance of the dynode resistor chain at the dynode connections. Nevertheless it is possible to keep all voltages constant which are essential for the amplification of the photomultiplier. This is important since drops in the load dependent dynode voltages would lead to a change of the amplification of the dynode stages, resulting in non-linearity of the output signal. Normally photomultiplier circuits with a high demand for linearity require either a very high current drain in the dynode resistor chain or a special stabilization of the voltage supply for several dynode stages. However, for the described arrangement of dynode chain resistors and load resistors in the form of a ladder network it is possible to reduce the power demand of the circuit considerably. A very good linearity of the output signal $U_s$ can still be obtained up to the maximum current capability of the photomultiplier. Only the voltage at dynode $D_4$ which is used as an anode is variable within certain limits. This voltage change however, has a negligible influence on the amplification and on the linearity if the positive drain voltage $+U_c$ is sufficiently high. This voltage should be at least equal to the stage voltage between the active dynodes. Other causes of non-linearity may also be compensated for by altering the resistance ratio $R_b/R_a$ or the stage amplification. At extremely high currents an individual optimalization for the different sensitivity position can be reached by a careful choice of resistances. As an example, the compensation of the voltage drop in a semi-transparent photocathode will be discussed in FIG. 3.

The circuit device described allows a reduction of the dynode chain current which offers general advantages — reduction of the power supply current, improved stability of the dynode chain resistors with the added advantage of compact mounting, and reduction of heat dissipation in the direct neighbourhood of the heat sensitive photomultiplier tube PM. A further advantage is the small loading of the output of the operational amplifier OP. The resistor $R_{b5}$ (shown in FIG. 1 by dotted lines) serves to keep this loading small also at the position of highest sensitivity.

The circuit shown in FIG. 1 can be extended to photomultipliers with an arbitrary number of dynode stages. In case the photomultiplier has more dynodes than will be needed at the maximum, the unused dynodes will be connected with the anode.

With respect to the different types of multiplier tubes available, it may be useful to modify the circuit shown in FIG. 1 as will be discussed below.

FIG. 2 shows an example of a circuit for a photomultiplier PM with a photocathode on a metal substrate and a circular-cage or a linearly focused dynode structure. This class of photomultipliers has a very high current capability at the photocathode, e.g. the well known side-on photomultipliers type 1P28 of RCA or 9781 of EMI with 9 dynodes. A load resistor $R_{ak}$ (FIG. 2) is inserted in the lead to the photocathode K and is connected to the switches $S_1$ and $S_2$ so that the phototube can also function as photodiode. Photocathode currents of 100 $\mu$A or more are possible. The circuit shown in FIG. 2 offers 6 sensitivity positions — photodiode and 1 to 5 dynodes. The higher dynodes $D_6$ to $D_9$, together with the anode A, are connected to the positive drain voltage $+U_c$. However, the anode and the dynodes $D_8$ and $D_9$ can also be connected to ground potential.

An important improvement of FIG. 2, compared with FIG. 1, is the parallelling of the dynode chain resistors $R_{b2}$ through $R_{b5}$ with diodes $D_{b2}$ through $D_{b5}$, the anodes of which are always directed to the lower dynode. A further extension is given by the resistor $R_c$ (e.g. $R_c = 3 R_b$) leading from the dynode resistor chain connection of the highest operable dynode to ground. If the number of active dynodes is reduced the diodes (e.g. $D_{b5}$) become conducting so that all dynodes higher than the last active dynode are connected with the drain voltage $+U_c$ and exhibit a reduced source resistance. This is important since an overlapping of the electrostatic field of several successive dynodes occurs with the electrostatically focused dynode structures. In this case at least two successive dynodes have to be connected together as an active anode. For the diodes $D_{b2}$ through $D_{b5}$ power diodes can be used, thus eliminating the risk of damage during dynode switching.

Another improvement shown in FIG. 2 is the insertion of resistors $R_d$ ($R_{d1}, \ldots, R_{d5}$) into the lead to the negative supply voltage $-U_B$. These resistors are switched together with switches $S_1$ to $S_3$ by a switch $S_4$. As a result, the stage voltage between the active dynodes is kept constant during switching (with $R_{d1}, \ldots, R_{d5} = R_b$).

This not only facilitates operation of individual photomultiplier circuits but also allows several photomultipliers to be run from the same supply voltage $-U_B$, independently of the number of dynodes selected individually. In contrast to the usual power supplies for photomultipliers the voltage $-U_B$ needs not to be varied.

On the other hand, if only one photomultiplier is operated from one power supply unit, it is possible to omit the resistors $R_d$, and to program the voltage of the supply unit via the switch $S_4$ which is coupled to the switches $S_1$ to $S_3$. The procedure may be even simplified if the switch $S_4$ is omitted and the voltage $-U_B$ is produced by means of a constant current source instead of a constant voltage source. Due to the compensation of the voltage changes in the dynode resistor chain, load-independent voltages are also obtained. During switching the supply voltage will change according to the number of dynode stages.

A condition different from equation (6) holds for the load resistor $R_{ak}$ in the supply line of the photocathode K as well as for the dynode chain resistor $R_{b1}$ of the first dynode stage. If $R_{b1} = R_b$ (disregarding a Zener diode $Z_1$ connected in series with the resistor $R_{b1}$ in FIG. 2), the compensation condition for an "ideal" photomultiplier operated with only one single active dynode is described by:

$$R_{ak} = \frac{n-1}{n} \cdot \frac{\nu - 1}{n} \cdot R_a ; \quad (R_{b1} = R_b) \qquad (7)$$

Alternatively one can put $R_{ak} = R_a$ and choose a lower value for $R_{b1}$. In order to reduce the dynamic resistance of $R_{b1}$ only and not the voltage at the first dynode stage, the resistor $R_{b1}$ has to be connected in series with a Zener diode $Z_1$ parallelled by a capacitor $C_z$ (e.g 0.5 $\mu$F). This version of the invention is of special interest with "real" photomultipliers where the electron collection efficiency $\beta$ at the first dynode deviates from unity and leads to a compensation condition differing from equation (7). If $R_{b1} = R_b$ even negative values for $R_{ak}$ could be obtained. For $R_{ak} = R_a$ one obtains for the operation with one active dynode:

$$R_{b1} = \frac{\beta(\nu - 1) - 1}{1 + \frac{\nu}{(\nu - 1)^2} \cdot \frac{1}{n-1}} R_a \simeq [\beta(\nu - 1) - 1] R_a , \quad (R_{ak} = R_a) \qquad (8)$$

where the small dynamic resistance of the Zener diode $Z_1$ has been neglected.

Omitting the possibility of operating the photomultiplier as a photodiode and putting $R_{ak} = 0$, the following equation holds:

$$R_{b1} = \beta(\nu - 1) R_a, \ (R_{ak} = 0) \qquad (9)$$

If $\beta = 0.8$ and $\nu = 5$, we have $R_{b1} = R_b$ and the Zener diode $Z_1$ can also be omitted.

Another way to achieve the compensation for operation with only one active dynode consists in selectively increasing the voltage at and thus the gain of the first dynode stage. For the circuit shown in FIG. 2 this can be achieved by different resistances $R_d$, e.g. by $R_{d1} = 2R_b$, $R_{d2} = 0$, and $R_{d3}, \ldots, R_{d5} = R_b$. Further aspects will be discussed in connection with FIGS. 4 and 5. In order to optimize the linearity in all sensitivity positions, it is necessary first of all to determine the ratio $R_b/R_a$ according to equation (6) for 3 and more active dynodes. The optimum value of the resistance $R_{b1}$ should then be found for operation with 2 active dynodes. Finally, the resistance $R_{d2}$ has to be varied for linearization when only one active dynode is used. The resistance $R_{d1}$ in the "photodiode" position is provided to give a constant loading of the operational amplifier and of the voltage supply $-U_B$ but its value is not critical. In general there is good agreement in linearity for photomultiplier tubes of the same type, so that choosing individual values of resistances is necessary only in extreme cases. This statement seems to contradict the fact that conventional multiplier circuits often show large individual deviations from ideal behaviour. Such deviations of individual phototubes are a result of tolerances involved in the manufacture of the dynode system. They have quite a large influence at low variable dynode voltages and, especially, at larger dynode numbers as compared with the present circuit. The present one is used with high and nearly constant voltages per stage and the lowest possible number of active dynodes.

As to the operational amplifier OP, modular or integrated amplifiers may be used, e.g. the well known circuit Fairchild 709. The input stage of the operational amplifier can be equipped with bipolar or field-effect transistors. For amplifiers having a differential input the non-inverting (+) input is connected to zero potential (ground) or to an offset compensating voltage. Choice of amplifiers depends on bandwidth and signal risetime as well as on the input resistance, on drifting and noise of the amplifier. Typical data for a circuit shown in FIG. 2 are $-U_B = -625$ V, $+U_B = +130$ V, $R_a = 27$ k$\Omega$, $R_b = 82$ k$\Omega$, $R_c = 390$ k$\Omega$. Based on these values, linearities of 1 % or better have been obtained with currents of up to 150 $\mu$A at the last active dynode. The wide band electronic signal-to-noise ratio of up to 300 kHz reached a value of 100 dB when a commercial amplifier was used. In any case the electronic signal-to-noise ratio is larger than the optical signal-to-noise ratio given by equation (1). These values are extremely good, especially as inexpensive standard type photomultipliers can be used. The power demand for the circuit is only little higher than for circuits used for statistic measurements. The gain variation covered by the switching of the dynode amounts to approximately 1:2000.

For short time measurements the transient response of the circuit according to FIG. 2 is important. It is determined not only by the operational amplifier OP but also by the load resistance $R_a$ and the stray capacitances between the dynodes, the connecting leads and the switching contacts. For the circuit described in FIG. 2 the parallel-connected diodes $D_b$ in the dynode resistor chain improve also the transient characteristics by reducing the RC-time constants in the connecting leads of those dynodes which act as the anode.

For further correction of the transient characteristics capacitors and resistors $C_f$, $R_f$, $C_f'$, and $R_f'$ are used. Without the resistor $R_f$ the capacitor $C_f$ acts as a stabilizing feedback capacitance to the operational amplifier. On the other hand, the stray capacitances between the last active dynode and the higher dynodes can also be used for stabilization. This can be achieved by means of the RC-combination $C_f'$ and $R_f'$ (where $R_f' << R_a$) which introduces a correction for the frequency response by a lead-in-phase. The elements $C_f$ and $R_f$ can then be used for optimal adjustment of the transient characteristics (e.g. with $R_f = 5 \ldots 10\ R_a$). However, a capacitive feedback also occurs via the lower dynodes across the dynode resistor chain. If the shortest possible transient time is required without reducing the resistances $R_a$ and $R_b$, then the time constants involved here are too large. For correction, small capacitors $C_g$ (e.g. 10 pF) can be inserted in series with resistors $R_g << R_a$ at the connections of the dynode resistor chain, e.g. corresponding to the second and fourth dynode ($C_{g2}$, $R_{g2}$ and $C_{g4}$, $R_{g4}$). Without the latter correction a detector risetime constant $\tau_D = 0.3$ $\mu$sec was obtained using a load resistance $R_a = 27\ k\Omega$. Introduction of the correction gave the result $\tau_D = 0.15$ $\mu$sec, using an operational amplifier with a bandwidth of serveral MHz. These values demonstrate that the present photomultiplier circuits compare favourably with the conventional circuits with respect to their transient characteristics. There is no deterioration in the longer time range. RC-filters in the power supply leads ($C_d$, $R_d' << R_b$, $C_c$, $R_c' << R_a$) do not show any influence if appropriately chosen.

Switching of the dynodes does not require a disconnection of the supply voltages $-U_B$ and $+U_c$ if the switches $S_1$ and $S_3$ are of the interrupting type. The switches $S_2$ and $S_4$ can be either interrupting or non-interrupting. During switching the input of the operational amplifier OP is guarded by a protection resistor $R_s$ and antiparallel Diodes $D_s$ which are connected to ground or biased by a small reverse voltage. These diodes cannot be damaged in this circuit due to the low currents. $R_s$ is, e.g., 1.5 $k\Omega$.

By using special switches the circuit design can be simplified. For instance, instead of the switch $S_3$ shown in FIG. 2, a summing type switch can be used which simultaneously links the dynode resistor chain connections of all the dynodes that should be on the positive drain potential (cf. FIG. 13; a different summing type switch $\overline{S}_o$ is used in FIG. 7). The diodes $D_b$ can then be omitted. Using special switches of this kind is a matter of series production. Essential requirements for the selection of the switches are high voltage stability, good insulation and low capacitances. Switches with glazed or siliconized ceramics are suitable. The circuit device of FIG. 2 exhibits further an overload indicator consisting of a Zener diode $Z_L$, a transistor $T_L$ with a basis resistor $R_L$ and a control lamp L.

Figure 3:
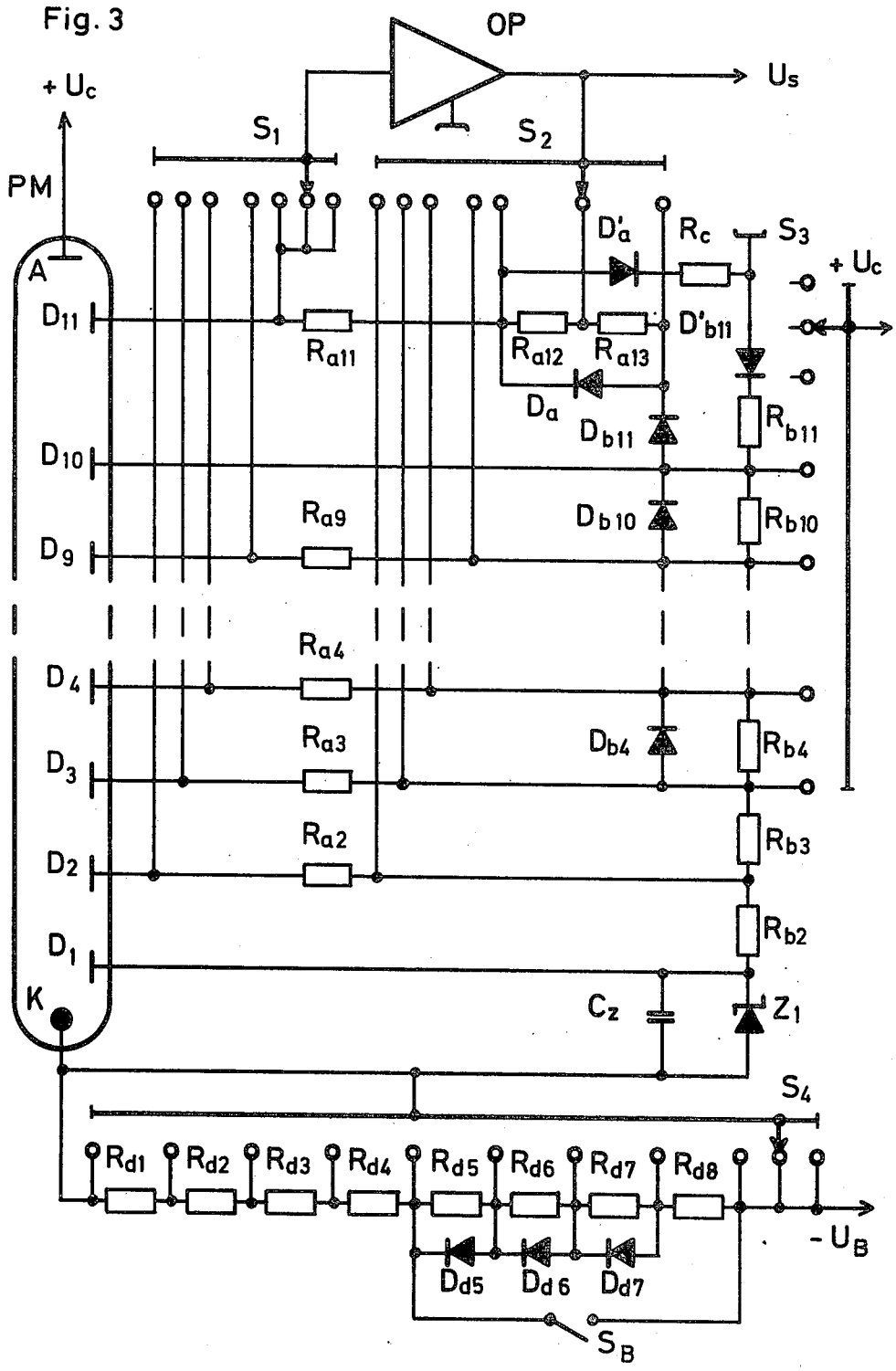
FIG. 3 is an example of a circuit device especially designed for end-on photomultipliers with a semi-transparent photocathode. Switching is variable from 2 to 11 active dynodes.

FIG. 3 shows a circuit device for end-on photomultipliers the photocathode of which is evaporated on the inner side of the entrance window (semi-transparent photocathode). The dynode system may have any structure. The present circuit device is especially versatile. Its amplification can be varied by a factor of $10^5$ or more. The maximum cathode current can amount to several $\mu$A, whereas its minimum value can be of a few pA or less. In the latter case the full amplification of a multi-stage multiplier tube is needed for the detection of the signal. Of course, a photomultiplier tube should not be switched directly from high light level applications to low light level applications which differ by a factor of $10^6$ because of the dark current that needs some time to decay. However, gain variations of $10^3$ can be covered instantaneously and are mostly sufficient in one experiment. Regarding this, the circuit is well suited as a multi-purpose device providing an extended range of sensitivity for laboratory use. A typical photomultiplier which may be used is EMI type 9558 or 9658 with a trialkali (S20) photocathode and 11 dynodes (venetian blind structure), or PHILIPS 56 T(U)VP and analogues such as EMI 9816 through 9818 or RCA 4459, 7268, and 7326 with 10 to 14 dynodes (electrostatically focused).

The circuit shown in FIG. 3 has been designed for operation with 2 to 11 active dynodes. In order to simplify the drawing, the dynodes $D_5$ through $D_8$ and the corresponding circuit elements and connections of switches are not shown. The RC-filters in the current-supply leads and the circuit elements for correcting the transient response and for protecting the operational amplifier during switching have also been omitted. These elements may be the same as in FIG. 2. Furthermore, the values of the resistances $R_a$($R_{a2}$, . . , $R_{a9}$, $R_{a11}$), $R_b$($R_{b2}$, . . , $R_{b11}$), $R_c$ and $R_d$ ($R_{d1}$, . . , $R_{d8}$), the diodes $D_b$($D_{b3}$, . . , $D_{b11}$,$D_{b11}'$) and the drain voltage $+U_c$ may be chosen as discussed in FIG. 2, whereas a higher value of the voltage $-U_B$ is required with respect to the larger number of dynodes. The absolute value of these voltages depends also on the multiplier tube, i.e. EMI 9816 may be operated at a higher voltage per stage than EMI 9558, especially at the anode. The design of the dynode resistor chain at the first dynode stage will be discussed below. Especially the Zener diode $Z_1$ has been selected for a much higher voltage as in FIG. 2 and the resistor $R_{b1}$ has been omitted.

The switching position "10 dynodes" is not provided. Instead of this, 3 positions "11 dynodes" are provided. In these positions the circuit can be used like a conventional photomultiplier circuit without dynode switching, allowing a variation of amplification by changing the supply voltage $-U_B$. The sensitivity range has been extended by means of load resistances $R_{a12}$ (e.g. $4R_a$) and $R_{a13}$ (e.g. 20 $R_a$) which are series-connected with the resistance $R_{a11}$ ($= R_a$). The input of the operational amplifier is then connected directly to the dynode $D_{11}$ via the switch $S_1$, whereas the output is switched to the load resistances via the switch $S_2$. During operation with 11 dynodes the compensation according to equation (6) has not been taken into account. However, similar to conventional circuits, the linearity with the full number of dynodes can be improved by increasing the voltage between the last dynodes (e.g. in case of EMI 9558: $R_{b2}, \ldots, R_{b10} = R_b$, $R_{b11} = 1.8R_b$). The upper end of the dynode resistor chain is kept at a potential near to ground by a rectifier diode $D_{b11}'$. When the number of active dynodes is reduced, the diode $D_{b11}'$ becomes non-conducting. Signal diodes $D_a$ and $D_a'$, connected in series between the diode $D_{b11}$ and the resistor $R_c$, now carry a current of the order $U_c/R_c$ and short-circuit the resistors $R_{a12}$ and $R_{a13}$, thus preventing the voltage at the dynode $D_{b11}$ from dropping too much (fail safe design). — The circuit design at the highest dynode could be the same as with FIG. 2 if the load resistors $R_{a12}$ and $R_{a13}$ are not provided.)

In applications where the photomultiplier PM is operated mainly with a low number of dynodes, the negative voltage $-U_B$ can be reduced by closing a switch $S_B$ and short-circuiting part of the resistors $R_d$. Resistors $R_{d5}$ through $R_{d7}$ will be short-circuited by diodes $D_{d5}$ through $D_{d7}$.

During operation with a low number of dynodes, the internal resistance of the photocathode becomes significant. Photocathodes which are evaporated on a glass window have a much higher resistance and thus a lower cathode current capability as compared to photocathodes on a metal substrate. High photocurrents will produce a locally varying voltage drop which results in defocusing of the photoelectrons onto the first dynode and in a reduced gain of the first dynode stage, both deteriorating the linearity of the output signal. Trialkali photocathodes have a rather low surface resistance and should be preferred. Special high current photomultipliers exhibit conductivity paths in the photocathode. But in this case, too, the voltage drop in the photocathode has to be taken into account.

In FIG. 3, considerable reduction of this non-linearity and thus an increase of the useful range of sensitivities has been obtained by increasing the voltage between the photocathode and the first dynode to a much higher value than usual, i.e. by a factor of at least 1.5 or 2. This has a favourable effect on the gain of the first dynode stage and improves the focusing of the photoelectrons onto the first dynode. In order to secure safe operating conditions up to, but not exceeding the maximum tolerated voltage, and to compensate for a large internal resistance of the cathode by the feedback-technique already described, the ohmic resistor $R_{b1}$ has been completely replaced by a Zener diode $Z_1$ to which a capacitor $C_z$ has been parallelled. As to the phototube EMI 9558, the voltage drop at the Zener diode can safely amount to 250 V. During operation at the "2 dynodes" position, the linearity can be adjusted further by selecting for the resistor $R_{b2}$ a value different from $R_b$ or by replacing it by another Zener diode.

Figure 4:
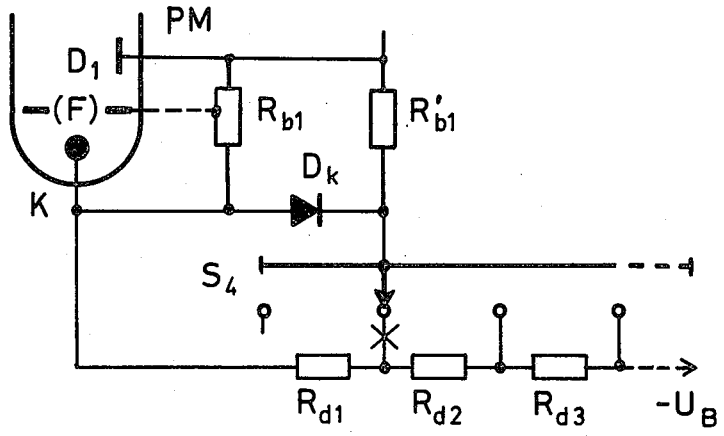
FIGs. 4 and 5: Improved versions of part of the circuit device shown in FIG. 3, designed for increasing the differential potential between the cathode and the first dynode when operated at lowest dynode number.

Experiments have shown that operation with few active dynodes allows a higher voltage between the photocathode and the first dynode than operation with a large number of dynodes. Furthermore, during operation with many dynodes the available voltage $-U_B$ should be distributed more uniformly to the dynode stages. FIG. 4 shows part of a circuit which permits a particularly large voltage increase in the lowest dynode position. No Zener diodes have been used in this circuit. In the lowest dynode position the switch $S_4$, and a diode $D_k$ in series with this switch and the cathode, are non-conducting. Thus the voltage between photocathode and dynode $D_1$ is given by the voltage drop at the resistor $R_{b1}$. During switching to a higher dynode position a resistor $R'_{b1}$ is parallelled to the resistor $R_{b1}$ and the voltage drop is reduced. However, a voltage increase at the first dynode becomes also effective in the next sensitivity position if the lead to the second switch contact is interrupted at the position marked by a cross and another resistor is inserted there. Suitable values are $R_{b1} = R_{b1}' = 3R_b$, $R_{d1} = 0 \ldots R_b$, $R_{d2} = 0 \ldots R_b$, and $R_{d3}, R_{d4}, \ldots = R_b$. A focusing electrode F of the photomultiplier, if there is any, will be connected either to the photocathode or to an intermediate point of the resistor $R_{b1}$ (e.g. EMI 9816). Adjustment of the voltage at this electrode affects the linearity, too, and may be used to minimize the change of the sensitivity profile of the photocathode as a function of the cathode current.

Figure 5:
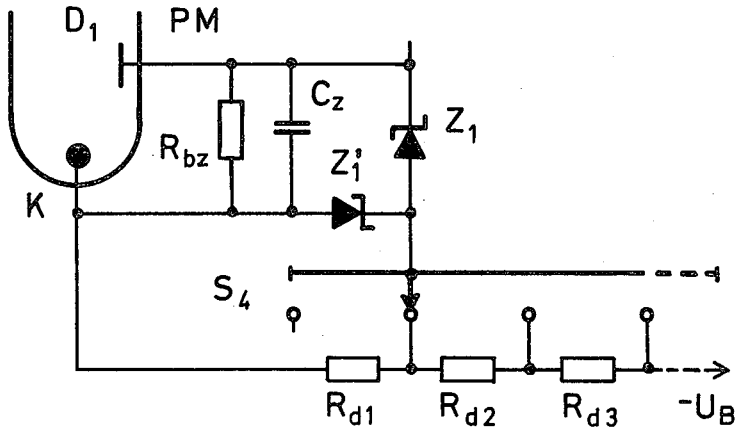

FIG. 5 is an extension to FIG. 4 where the voltage between the photocathode K and the dynode $D_1$ is stabilized by means of Zener diodes. In the lowest dynode position two Zener diodes $Z_1$ and $Z_1'$ are series-connected. In the other dynode positions the diode $Z_1'$ is forward biased as a normal diode by a biasing resistor $R_{bz}$ (e.g. = 10 $R_b$).

Figure 6:
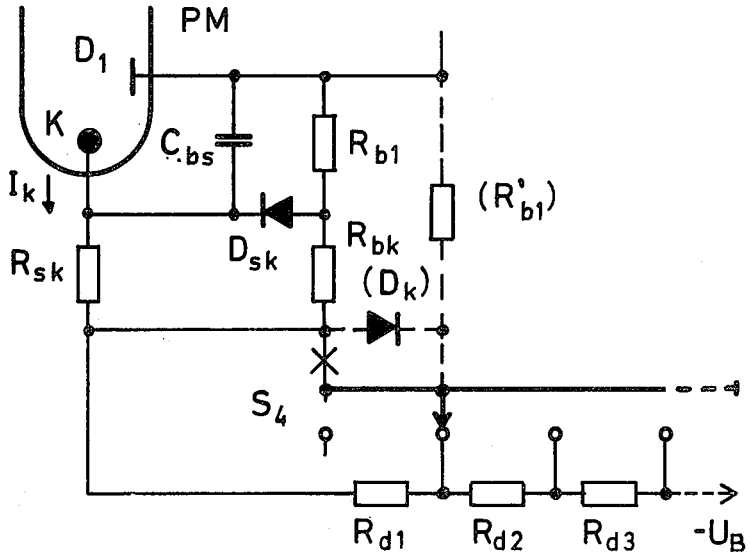
FIG. 6: Improved version of part of the circuit device shown in FIG. 3, designed as an overload protection circuit for the cathode.

FIG. 6 is a protection circuit for the photocathode which avoids overloading of the photomultiplier in experiments with high light levels. This circuit consists mainly of three new elements: one resistor $R_{bk}$, which is of the order of $R_b$ and is series-connected with the dynode resistor chain, and one clamping diode $D_{sk}$ together with a high-ohmic resistor $R_{sk}$ leading from the cathode to the lower end of the resistor $R_{bk}$. At low cathode currents $I_k$, the cathode voltage is clamped by the diode $D_{sk}$. If the cathode current becomes too high, the voltage drop across the resistor $R_{sk}$ becomes larger than the voltage drop across the resistor $R_{bk}$ and the diode $D_{sk}$ becomes non-conducting. Thus the voltage between the cathode and the first dynode decreases and the currents of the photocathode and the dynode system are limited. As the pulse current capability of photomultipliers is much higher than the DC-current capability, a capacitor $C_{bs}$ in parallel to the first dynode stage may be provided in order to limit stationary photocurrents only.

The circuit elements $D_k$ and $R_{b1}'$ (FIG. 6, in dotted lines) show how the circuits of FIGS. 4 and 6 can be combined. The lead to the switch $S_4$ has to be interrupted at the position marked by a cross. For a combination of the circuits shown in FIGS. 5 and 6 the elements $R_{b1}'$ and $D_k$ have to be replaced by the Zener diodes $Z_1$ and $Z_1'$. In this case the voltage drop at the Zener diode $Z_1$ has to be increased by the voltage drop at the resistance $R_{bk}$. It may be seen that the clamping current through the diode $D_{sk}$ will be increased in the lowest dynode position.

Circuits similar to FIGS. 2 and 3 may also be suitable for electron multipliers which are used for the detection of ions, electrons, and short-wave UV- or X-ray quanta. In contrast to photomultipliers, such "particle multipliers" do not have a special cathode normally. After passing a diaphragm the particles to be detected are led directly to the first dynode of the multiplier system where secondary electrons are emitted. For detection a multiplication of the electrons by several dynode stages is required. Therefore, the special problems encountered in the case of photomultipliers operated as photodiodes or with a small number of active dynodes do not have to be considered. Nevertheless, a dynode switching circuit for operation with a higher number of dynodes may be useful to avoid a reduction of the dynode voltage at higher particle flow densities and to secure a high linearity of the output signal.

PHOTOMULTIPLIER CIRCUITS WITH REDUCED RISETIME $\tau_D$.

If the current drain in the dynode resistor chain is not to rise above a few milliamperes with respect to power dissipation, the shortest risetime $\tau_D$ that can be obtained with multiplier circuits according to FIGS. 1, 2 and 3 is of the order of 100 nsec, using currently available multiplier tubes and circuit elements. However, shorter risetimes are often required. In conventional multiplier circuits, a standard technique is parallelling the dynode chain resistors by capacitors, especially for measuring light pulses. The current drain of the dynode resistor chain can thus be limited in spite of high pulse currents at the anode. At the anode itself load resistance of 50 to 1000 Ω are used. Frequently, the load resistance is given directly by the characteristic impedance of a coaxial cable without using an amplifier. A serious disadvantage of these circuits is that the dynode potentials change at fast pulse repetition rates and strong pulses. This results in a non-linear transient response which, e.g., becomes a limiting factor in pulse-height analysis. A further disadvantage of these circuits is the small variation of gain which can be achieved by varying the dynode voltage. The necessary large output currents at small load resistances can only be obtained at high dynode voltages. The current risetime of the multiplier tubes is also voltage dependent. In order to reduce the risetime $\tau_D$ the present circuit has been modified as described below:

1. At the last active dynode from which the signal current is supplied, the effective load resistance is reduced in order to decrease the influence of stray capacitances on the risetime. This can be achieved without changing the load resistors $R_a$ and the dynode chain resistors $R_b$ by adding an additional load resistor $R_a'$ which is inserted between the input of the operational amplifier OP and ground. The compensation condition given by equation (6) remains unchanged.

2. The voltage at the other dynodes is kept constant during the transient state by inserting capacitors $C_b$ between these dynodes and ground.

Figure 7:
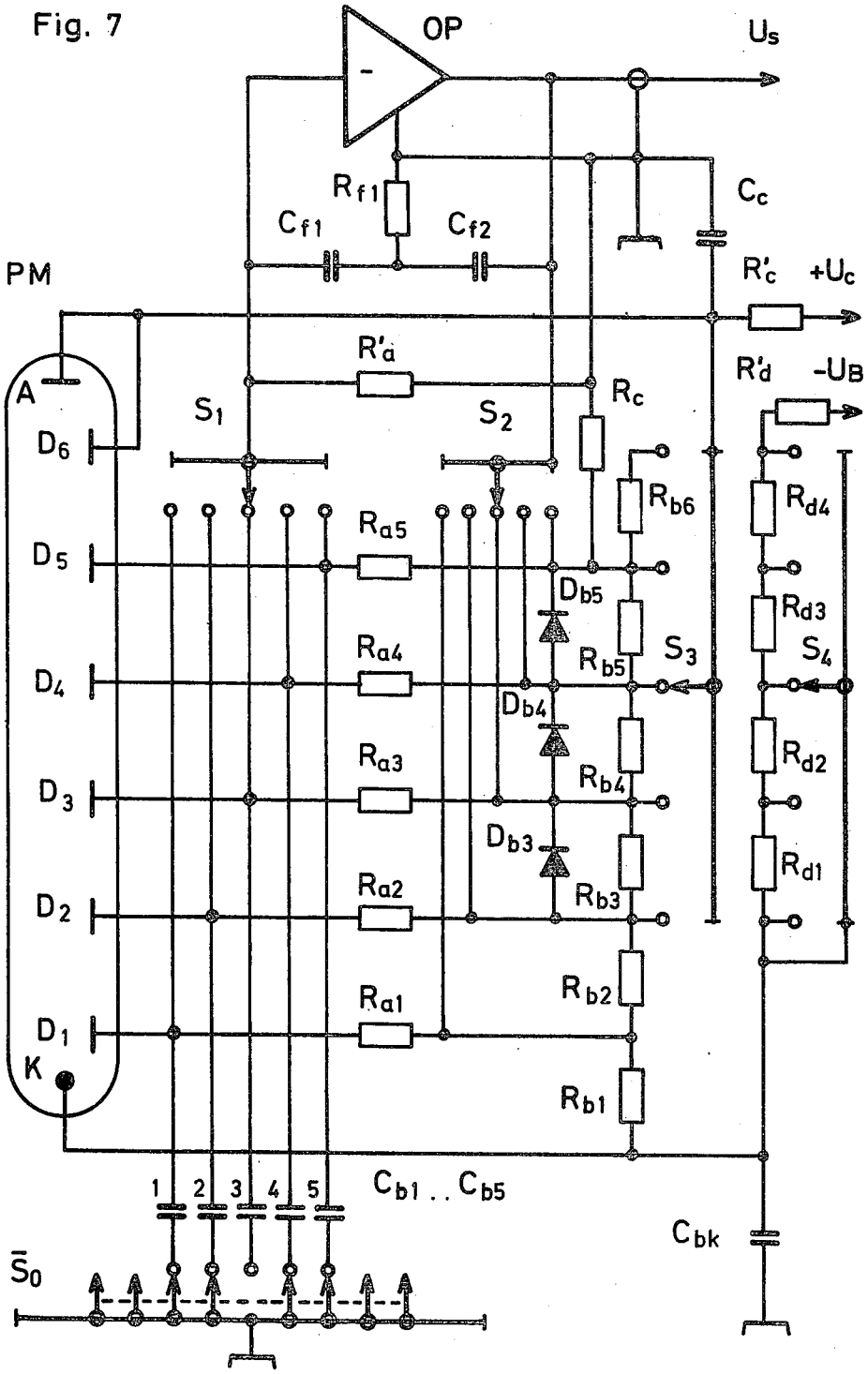
FIGS. 7 and 8: Circuit devices for a photomultiplier with reduced signal risetime. Switching is variable from 1 to 5 active dynodes.

The corresponding modified version of a circuit shown in FIG. 2 is shown in FIG. 7. The dynode switching ranges from 1 to 5 active dynodes. There are six capacitors $C_{bk}, C_{b1}, \ldots, C_{b5} = C_b$. The capacitor $C_{bk}$ is connected between the cathode and ground. The other capacitors are linked to the dynodes $D_1$ through $D_5$ and grounded via a complementary summation switch $\overline{S}_o$. This switch is mechanically coupled to the switches $S_1$ through $S_4$ and opens the contact only which corresponds to the last active dynode (e.g. $D_3$ with $C_{b3}$), whereas all other contacts are closed. The risetime $\tau_D$ is determined by the stray capacitances, by the AC-parallelled resistances $R_a$ and $R_a'$ and by the operational amplifier. The latter is stabilized and corrected for its frequency response by a network $C_{f1}$, $C_{f2}$, and $R_{f1}$. The elements $R_g$ and $C_g$ of FIG. 2 are omitted. Unlike conventional multiplier circuits where the capacitors are either connected in parallel to the dynode chain resistors or to ground, very small capacitors $C_b$ can be used. This is due to the fact that the compensation condition of equation (6) is independent of the size of the additional load resistor $R_a$. As soon as the transient state of the amplifier has settled, the voltages at all active dynodes are stabilized at their initial values because of the voltage feedback. Therefore, it is sufficient that the time constant $$\tau_b = C_b \cdot R_a' \qquad (10)$$

is chosen to be of the same order of magnitude as the risetime $\tau_D$ or somewhat larger, e.g. $\tau_b = 2 \ldots 20 \cdot \tau_D$. In practice this corresponds to a value $C_b$ of 10 to 500 pF. The lower limit of $C_b$ is determined by the pulse currents involved, but also by the stray capacitances between the dynodes, the connecting leads and the circuit elements, compared to which $C_b$ must be larger. The additional load resistor $R_a'$ of FIG. 7 may be series-connected with a capacitor of the order of $C_b$. This gives reduced low-frequency noise and drifting of the current-to-voltage transducer. Furthermore, the stabilizing network $R_{f1}$, $C_{f1}$, and $C_{f2}$ may be selected such that no separate resistor $R_a'$ in series with a capacitor is needed. In this case the resistor $R_{f1}$ equals $R_a'$, and the capacitor $C_{f1}$ is of the order of $C_b$. In another variant of FIG. 7, the risetime $\tau_D$ can be varied by switching the stabilizing network together with the resistor $R_a'$ or $R_{f1}$, respectively (e.g. by values of $R_a/9$, $R_a/2$, and $\infty$).

Figure 8:
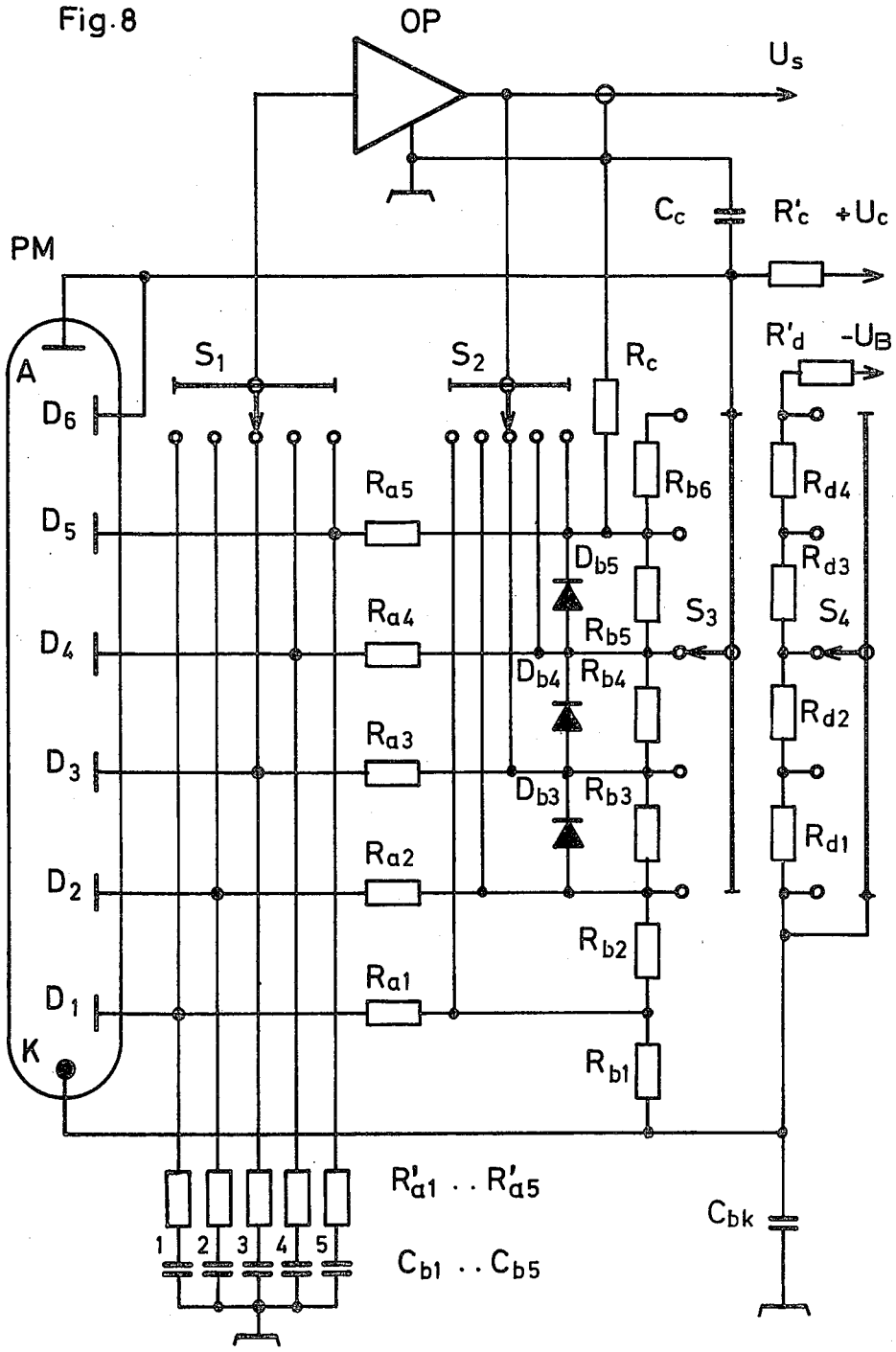

FIG. 8 shows a modified circuit device where no complementary summation switch $\overline{S}_o$ is required. Between the dynodes and ground separate additional load resistors $R_{a1}'$ through $R_{a5}' = R_a'$ have been inserted, which are series-connected with the capacitors $C_{b1}$ through $C_{b5}$. In this case, too, the high frequency circuit resistance at the dynodes can be made small enough to obtain reduced risetimes $\tau_D$. Values are chosen similar to FIG. 7.

Figure 9:
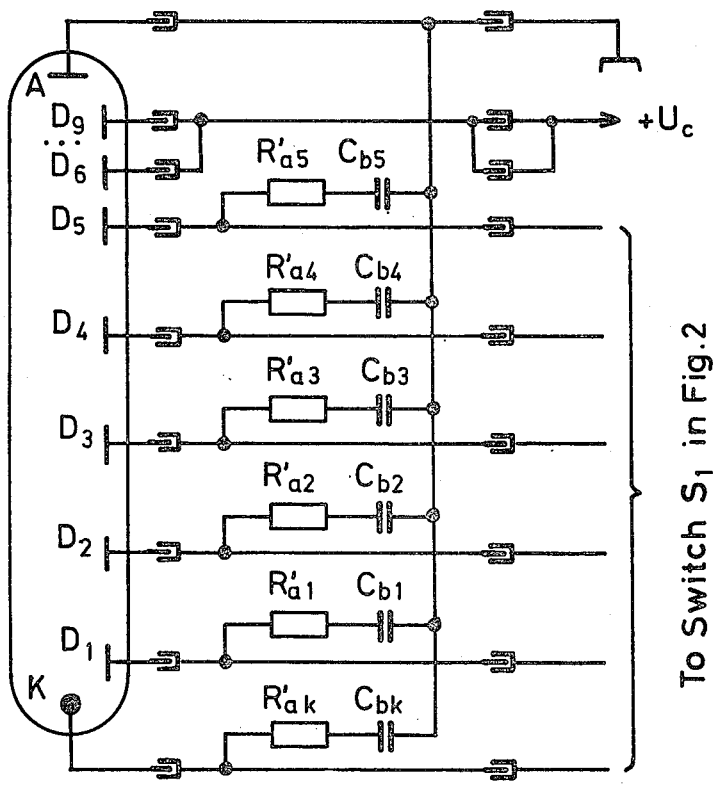
FIG. 9: Circuit device of a plug-in adaptor for modification of a circuit shown in FIG. 2 into a circuit similar to that as shown in FIG. 8.

Circuits according to FIG. 2 can be changed into circuits similar to FIG. 8 if the additional elements $C_{bk}$ through $C_{b5}$ and $R_{a1}'$ through $R_{a5}'$ are enclosed in an adaptor which is inserted into the plug-in-socket of the photomultiplier PM and accepts the latter. An adaptor of this type is shown in FIG. 9 where a further resistance $R_{ak}'$ has been added for the cathode. Adaptors of this type may be used when large numbers of circuit devices as in FIG. 2 or 3 are manufactured. Using adaptors facilitates stock-keeping and enables an optimal matching of the additional load resistances $R_a'$ and the risetime $\tau_D$ for the specific problem in hand. The operational amplifier OP should have a socket and be changed, too.

In stationary high current applications, the devices according to FIGS. 7 and 8 will have a fairly large static voltage drop at the resistors $R_a$ in the leads to the higher dynodes which act as an anode. This effect can be avoided by a summation type switch which is linked directly to the dynodes $D_2$ through $D_5$ and connects the higher dynodes (e.g. $D_4$ and $D_5$) simultaneously to the drain voltage $+U_c$, bypassing the relevant load resistors (e.g. $R_{a4}$ and $R_{a5}$). The diodes $D_{b3}$ through $D_{b5}$ are not required.

A disadvantage of the latter modification is the increase of stray capacitances which is also present with the complementary summation switch $\overline{S}_o$ used in FIG. 7. Special low capacitance switches could be used therefore. In a more favourable version based on FIG. 8, the switch $S_3$ is wired so that the higher dynodes are not connected to the positive potential via the load resistors $R_a$ but via the additional load resistors $R_a'$ which will have a considerably lower impedance. The switch capacitance, which is then parallel to the capacitors $C_b$, is not critical. When a summation type switch is used for $S_3$, the diodes $D_b$ can be omitted, too.

Figure 11:
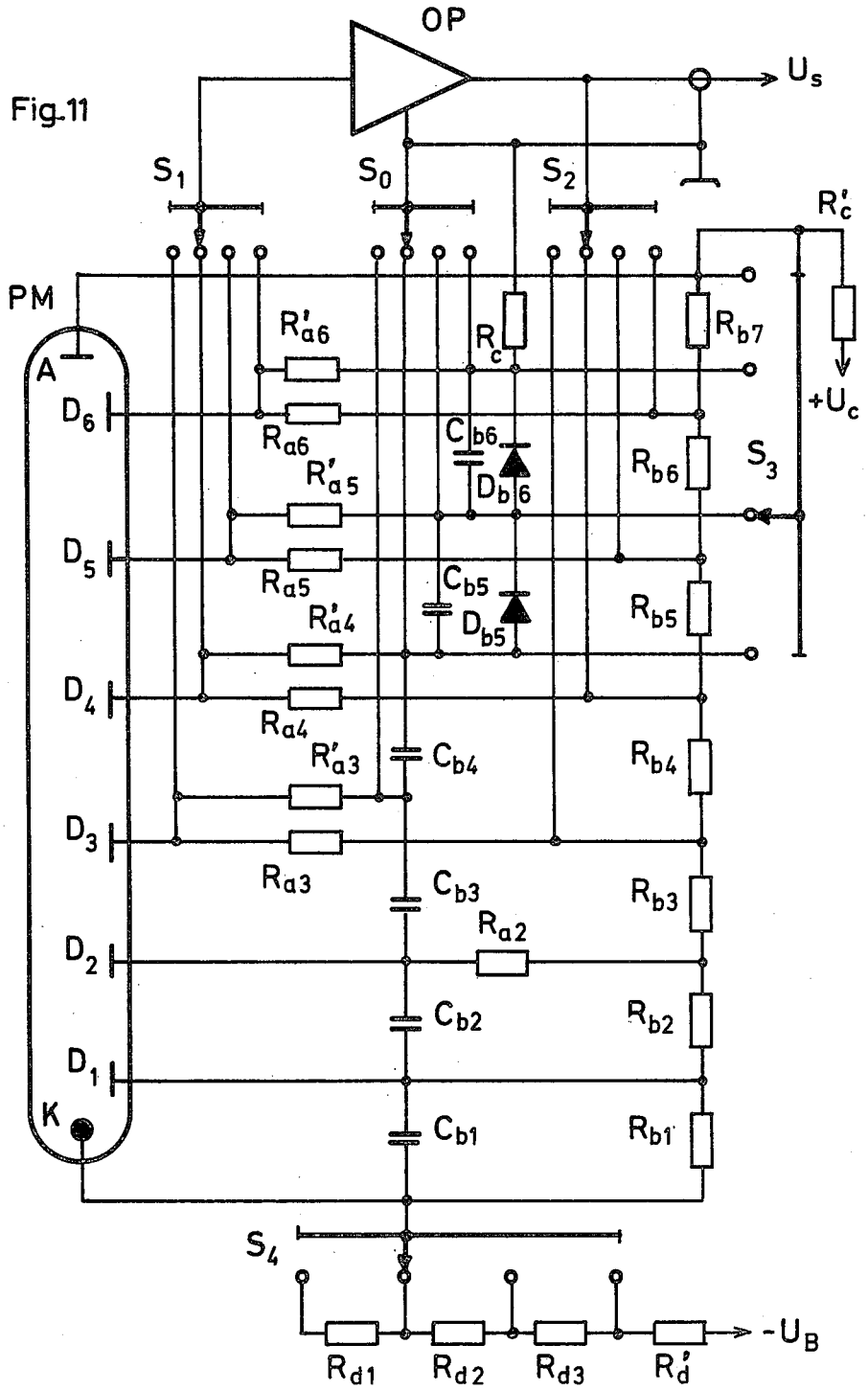
FIG. 11: Circuit device for photomultipliers with very short signal risetimes. Switching is variable from 3 to 6 active dynodes.

A functionally similar circuit is shown in FIG. 11, using standard switches without wipers provided for summation. Switching ranges from 3 to 6 active dynodes, the number of which may be modified if necessary. The capacitors $C_{b1}, \ldots, C_{b6} = C_b$ are series-connected. They are connected directly to the first non-variable dynodes and then to the additional load resistors $R_{a3}', \ldots, R_{a6}' = R_a'$ on the side of the dynode resistor chain. This capacitor chain, together with the additional load resistor of the last active dynode (e.g. $R_{a4}'$ to $D_4$), is grounded via the switch $S_o$. The additional load resistor of the next highest dynode (e.g. $R_{a5}'$ to $D_5$) is connected to the voltage $+U_c$ via the switch $S_3$ and a low impedance resistor $R_c'$. The diodes $D_{b5}$ and $D_{b6}$ between the connections of the switch $S_3$ are parallel to the capacitors $C_{b5}$ and $C_{b6}$. With 3 and 4 active dynodes, both of them, respectively $D_{b6}$, will have a low impedance due to a current of order $U_c/R_c$. In order to improve the compensation with 3 active dynodes a resistor $R_{a2}$ (equal to $R_a$) has been inserted in the lead to the dynode $D_2$. If the diodes $D_b$ have a very low leakage current the switch $S_o$ in FIG. 11 may be omitted. In this case the capacitors $C_b$ related to the various dynodes will not be arranged as a chain but connected directly to ground similar to FIG. 8. A capacitor $C_b$ should also be inserted between the dynode $D_2$ and ground, requiring one capacitor $C_b$ more than in the original circuit of FIG. 11. The capacitance of the diodes $D_b$ is not critical.

For circuits which have reduced risetimes in the nsec range the selection of the operational amplifier OP may present some difficulties. With a decreasing signal risetime $\tau_D$ and a decreasing ratio of $R_a'/R_a$, a larger gain-bandwidth-product of the operational amplifier is required.

These difficulties can be overcome if two operational amplifiers are used instead of one. One amplifier serves for signal decoupling at low gain and high bandwidth. The second one is placed in the feedback loop of the dynode resistor chain and secures a higher gain at lower bandwidth.

Figure 10:
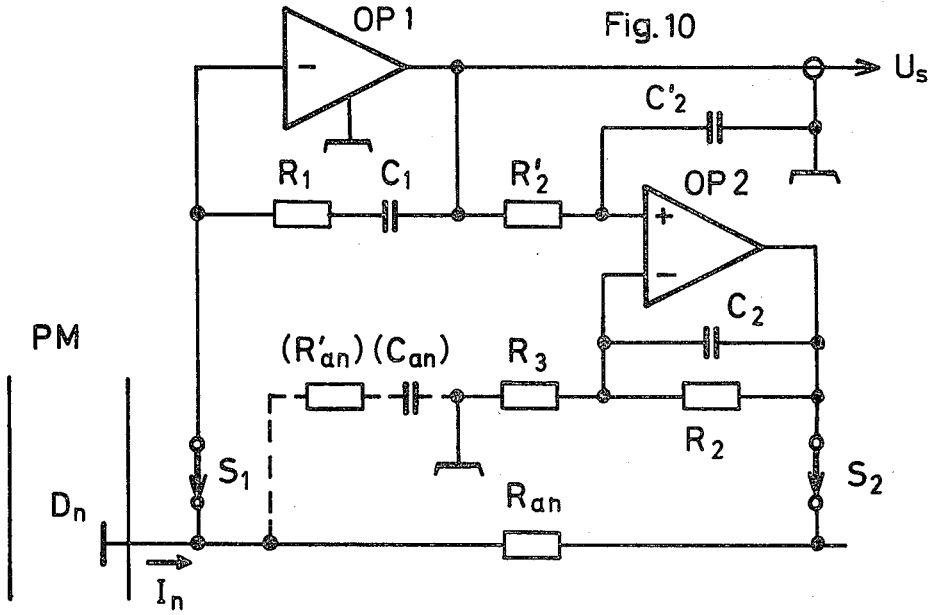
FIG. 10: Version of operational amplifier circuit for use with circuits as described in FIGS. 7, 8, and 11 with improved signal output.

An operational amplifier circuit of this kind, which may be used with the devices of FIGS. 7 to 9 and 11 is shown in FIG. 10. $D_n$ is the last active dynode of the multiplier tube PM and $R_{an} = R_a$, $R_{an}' = R_a'$, $C_{bn} = C_b$. Let us assume a ratio of $R_a'/R_a = 1/10 \ldots ⅓$. The input of the operational amplifier $OP_1$ is connected to the wiper of the switch $S_1$, whereas the output of the operational amplifier $OP_2$ is connected to the wiper of the switch $S_2$. A resistor $R_1$ and a capacitor $C_1$, connected in series, have been inserted in the direct feedback-loop of the fast amplifier $OP_1$. A value is chosen for the capacitor $C_1$ so that the time constant $\tau_1 = R_1 \cdot C_1$ is large compared to the risetime $\tau_D$. The elements $R_{an}'$ and $C_{bn}$ (in dotted lines) do not refer to FIG. 7 in which the resistor $R_1$ can act as the additional load resistor $R_a'$. (Series-connection of $R_a'$ with a capacitor has already been discussed in conjunction with FIG. 7.) As to the application to FIGS. 8 and 9, one should have $R_a' \leqslant R_1 \leqslant R_a/3$. The same holds for an application to FIG. 11 where the resistor $R_{an}'$ is grounded without the capacitor $C_{bn}$. The output voltage $U_s$ of the amplifier $OP_1$ is connected by a low-pass filter $R_2'$, $C_2'$ to the non-inverting input of the amplifier $OP_2$, which has the resistors $R_2$ and $R_3$ and a capacitor $C_2$ in its feedback-loop. The values should be $R_2' = R_2 \cdot R_3/(R_2+R_3)$ and $C_2' = C_2$. Neglecting the open-circuit frequency response of both amplifiers, the relation between the signal current $I_n$ at the last active dynode and the output voltage $U_s$ is $$I_n = \frac{U_s}{R_1} - \frac{1}{1+j\omega\tau_1} \cdot \frac{U_s}{R_1} + \frac{1}{1+j\omega\tau_2} \cdot \frac{R_3}{R_2+R_3} \cdot \frac{U_s}{R_a} \qquad (11)$$

where the angular frequency $\omega = 2\pi f$ and $\tau_i = R_i C_i$ ($i$=1,2). If $$\tau_1 = \tau_2 \qquad (12a)$$

and $$(R_2+R_3)/R_3 = R_a/R_1 \qquad (12b)$$

then $$U_s = I_n \cdot R_1$$

independently of $\omega$. Regarding the finite signal lag time $\tau_{o2}$ of the amplifier $OP_2$, this condition is modified to $$\tau_1 = \tau_2 + \tau_{o2} \qquad (12c)$$

where $\tau_2 >> \tau_{o2}$. The output voltage of the amplifier $OP_2$ is $$\frac{R_2+R_3}{R_3} \cdot U_s = I_n \cdot R_a \qquad (13)$$

where the transient time constant is $\tau_1$. The value of the capacitors $C_b$ must be chosen so that the time constant $\tau_b = R_a' \cdot C_b$ is a multiple of the time constant $\tau_1$. Typical data for application of the circuit of FIG. 10 to one of the fast multiplier circuits already described are as follows: Gain-bandwidth product of $OP_1 \geqslant 30$ MHz and of $OP_2 \geqslant 7$ MHz; $R_a = 20\ k\Omega$, $R_a' = 2\ k\Omega$, $R_1 = 3\ k\Omega$; $\tau_D = 15$ nsec, $\tau_1 = 2\ \mu$sec, $\tau_b = 10\ \mu$sec. Drifting (offset voltage) and low frequency noise depend mainly on the amplifier $OP_2$, whereas the high frequency noise is due to the amplifier $OP_1$. The lower limit of $C_b$ and thus of the ratio $\tau_b/\tau_1$ is determined by the maximum pulse load at the maximum permissible deviation of linearity.

The described separation of wide-band amplification by the amplifier $OP_1$ and of large-amplitude amplification by the amplifier $OP_2$ offers the advantage that the first amplifier does not have to supply an extremely high power at a low-ohmic signal output, whereas the second one fulfills the compensation condition of equation (6) without need for an extremely large slow rate.

Figure 12:
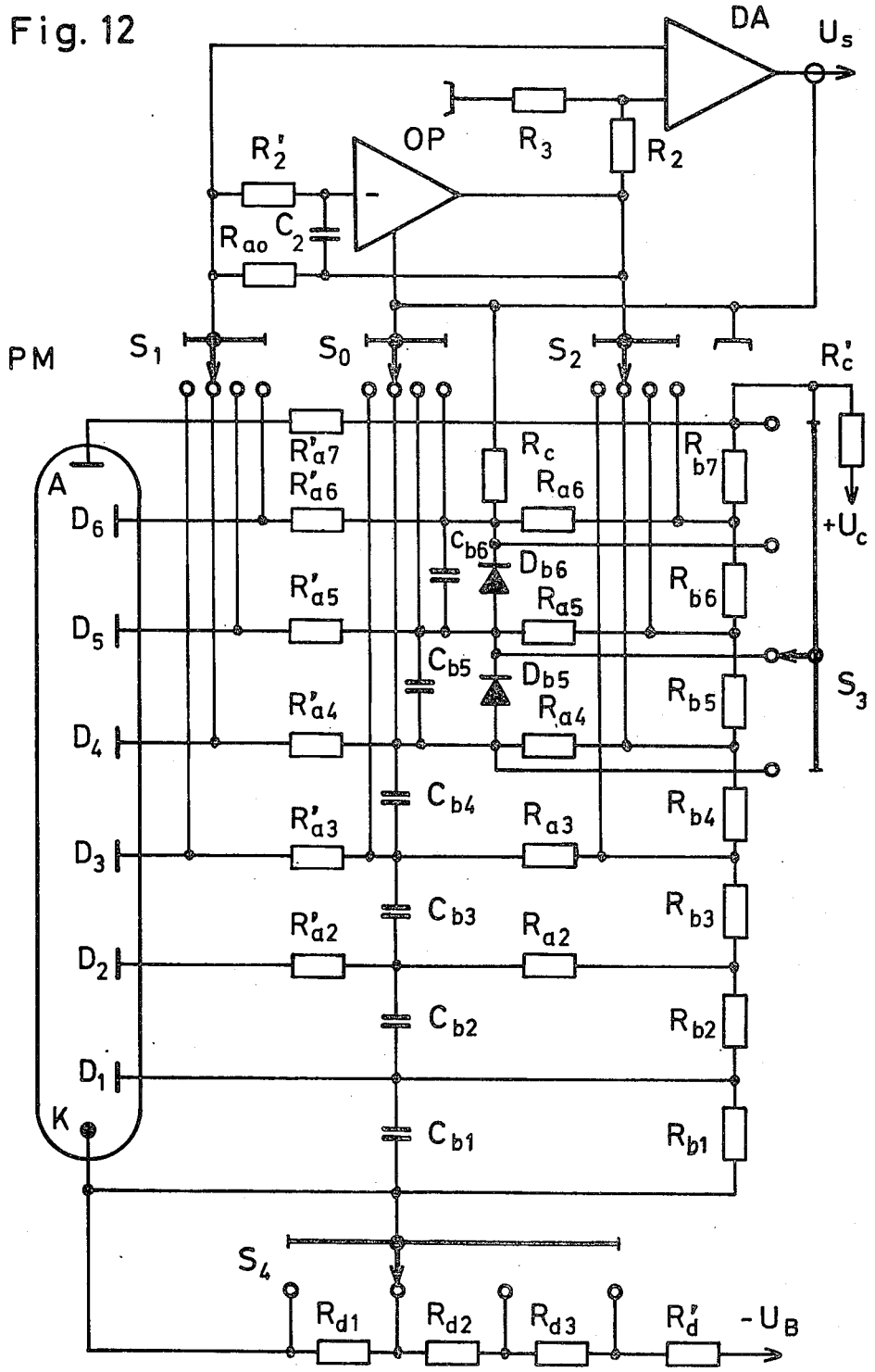
FIG. 12: Circuit device similar to FIG. 11, also using a differential amplifier with the signal output.

Whilst the aforementioned circuits usually work with a resistance ratio $R_a'/R_a = 1/10 \ldots < 1$, the circuit described in FIG. 12 allows shortest risetimes $\tau_D$ of up to a few nsec and extreme resistance ratios $R_a'/R_a \leqslant 1/10$, e.g. $R_a' = 300\ \Omega$, $R_a = 10\ k\Omega$. As in FIG. 11, the circuit in FIG. 12 allows switching between 3 to 6 active dynodes. This range may also be modified. Similarily to FIG. 10 two amplifiers are used. The main difference from FIGS. 10 and 11 is that the load resistors $R_a$, linked to the dynode chain resistors $R_b$, are not connected directly to the dynodes but to the connections of the switch $S_o$ behind the additional load resistors $R_a'$. As the load resistor of the last active dynode (e.g. $R_{a3}$) is short-circuited to ground, a further load resistor $R_{a0} = R_a$ has been put between the input and the output of the operational amplifier OP in order to fulfill equation (6). A differential amplifier DA, which need not be an operational amplifier, serves as a fast amplifier for the signal output. One input of the amplifier DA is connected directly to the last active dynode via the switch $S_1$. The other input is connected to the output of the slower operational amplifier OP via a voltage divider $R_2$, $R_3$. The reciprocal division ratio of the voltage divider should equal the loop gain of the amplifier OP, i.e. in FIG. 12:

$$(R_2+R_3)/R_3 = 1 + R_a/R_a' + R_a/R_2' \qquad (14)$$

The transient time $\tau_2$ of the operational amplifier OP is determined by the elements $R_2'$ and $C_2$ as $$\tau_2 = R_2'C_2 \cdot \left(1 + \frac{R_a}{R_a'} + \frac{R_a}{R_2'}\right) = R_2'C_2 \cdot \left(1 + \frac{R_2}{R_3}\right) \quad (15)$$

The use of externally compensated operational amplifiers is recommended for the amplifier OP because of the high loop gain needed (e.g. Fairchild 715 together with a booster stage). A resistor $R_{a2}$ is inserted in the lead to the dynode $D_2$ (see also FIG. 11). The resistor $R_{a2}'$ between the dynode $D_2$ and the corresponding capacitor $C_b$ serves to damp transient phenomena. This known damping function holds also for all other resistors $R_a'$ which are not connected to the last active dynode. The value of the capacitors $C_b$ depends on the maximum pulse current. The time constant $\tau_b = R_a'C_b$ should also be at least equal to or larger than $\tau_2$.

In the case of very strong current pulses (if special high current photomultipliers are used) a too large voltage drop could occur at the last active dynode during the transient state of the amplifier OP, i.e. in a time range $\tau_D \leq t < \tau_2$. This effect can be avoided by replacing the differential amplifier DA by a very fast current-to-voltage transducer. The circuit will then correspond to the device of FIG. 11 where the capacitor $C_1$ and the dashed capacitor $C_{bn}$ are short-circuited and no resistor $R_{an}$ (or $R_{ao}$ of FIG. 12) is between the switches $S_1$ and $S_2$. It is useful to have $R_a' \leq R_1 \leq 3R_a'$. For compensating the voltage drop in the dynode resistor chain, the ratio of $R_2$ and $R_3$ is still given by equation (12) if $R_a$ and $R_b$ are selected according to equation (6).

In this circuit variant, the absolute value of the load resistors $R_a$ becomes less significant than in the preceding circuits. $R_a$ must be large enough that the output of the amplifier $OP_2$ is not overloaded. An approximate condition for the voltage drop compensation will then be:

$$(R_2+R_3)/R_3 = R_b/(k \cdot R_1),\ v-1 \leq k \leq v-2 \quad (16)$$

where $v$ is the gain per dynode stage. Furthermore, if $k < v-2$, other sources of non-linearity may also be compensated for. This extended compensation technique will be dealt with in a more suitable circuit below.

PHOTOMULTIPLIER CIRCUITS WITH REDUCED RISETIME, SECOND TYPE

Obviously the circuits shown in FIGS. 10 to 12 become somewhat complex if a very short signal risetime $\tau_D$ is needed and the voltage drop in the dynode resistor chain is to be compensated for. These difficulties are due to the increasing resistance ratio $R_b/R_a'$ when a lower limiting value of $R_b$ is given. Returning to the basic design of FIG. 1, a simplified approach will be useful to compensate for non-linearities by a feedback via the dynode resistor chain. One should also take into account that non-linearities in short-time high-current applications are not only due to a voltage change at the dynode terminals but also due to the inherent properties of the photocathode and of the dynode system (especially effects of saturation). As to semi-transparent photocathodes, this problem has already been dealt with in the circuit design of the first dynode stage in FIGS. 3 to 5. Also similar to the dimensioning at the first dynode stage in FIGS. 2, the resistors in the dynode resistor chain need not be ohmic ones and may be represented by series-connected Zener diodes and ohmic resistors. In equation (6), however, only the dynamic resistance dU/dI of the dynode chain resistors is involved which is almost equal to the contribution of the ohmic resistors. Starting from the device of FIG. 2 one may therefore design a circuit where no additional load resistors $R_a'$ are needed:

$$R_a = 1.5\ k\Omega,\ R_b = 4.7\ k\Omega,\ \tau_D = 15 \text{ nsec}$$

The resistors $R_{b2}$ through $R_{b5}$ in FIGS. 2 must then be replaced by combinations of Zener diodes of, e.g., 180 Volts and 4.7 $k\Omega$-resistors similar to the shown series-connection of $Z_1$ and $R_{b1}$, the values of which have also to be changed to the new values. (According to equations (8) and (9) $R_{b1}$ should be of the order of 3 $k\Omega$, *or the cathode load resistor* $R_{ak}$ should be omitted). Capacitors $C_z$ will be paralleled to the Zener diodes and will not be critical. Capacitors $C_g$ may be used, too, and resistors $R_g$ may be of the order of 1 $k\Omega$ (at least with half the dynodes). The operational amplifier circuit must be modified according to the required bandwidth. Resistors $R_{d1}$ . . $R_{d5}$, on the other hand, must be selected for the required DC-voltage drop, i.e. $R_d = 82$ $k\Omega$ if the dynode chain current is approximately 2 mA.

It is obvious that this modified circuit must be operated at constant supply voltages $-U_B$ and $+U_c$ and that the multiplier gain cannot be varied via the power supply. As already mentioned, this will be a minor disadvantage in dynode switching circuits because gain intervals of the order of 5 can easily be handled by posterior electronic amplification. The resistors $R_b$ and $R_d$ will provide a constant current through the Zener diodes after the supply voltages have been adjusted.

A more serious limitation specificly involved with high signal currents results from the multiplier tube non-linearity. This non-linearity can also be compensated for in a given signal current range if the ratio $R_b/R_a$ is reduced as compared with equation (6). However, depending on the individual degree of non-linearity, theory yields optimal values of $R_b/R_a$ ranging from approximately 3 to 1 and zero, or even negative values in extreme cases. Thus it could be more adequate to omit the resistors $R_b$ and to replace them totally by Zener diodes whereas the power supplies may be converted into constant current sources and the switchable resistors $R_d$ will be omitted, too.

Figure 13:
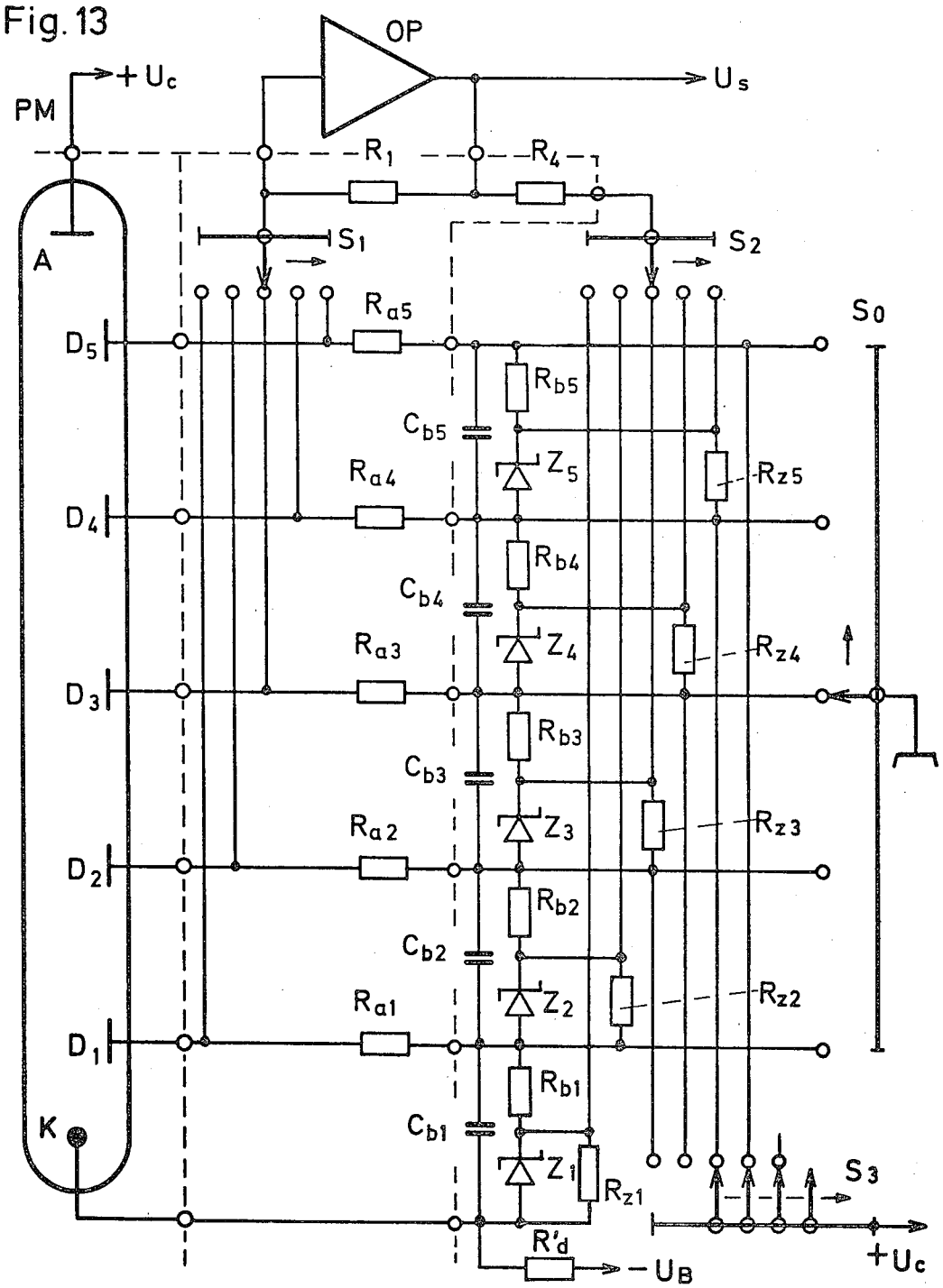
FIG. 13: Modified circuit device for photomultipliers.

The circuit device of FIG. 13 offers an improved facility for compensating non-linearity errors. It has also been designed for easy modification of the circuit data, which will be described below.

By way of example, FIG. 13 ranges from 1 to 5 active dynodes. The cathode must have a very low internal resistance for using the lower ranges (cathode on metal substrate). Focused caesium-berylliumoxide dynodes are preferred. The dynodes beyond the last active dynode are paralleled to the anode and connected to the drain voltage $+U_c$ by a summation type switch $S_3$ already mentioned. (A conventional switch $S_3$ could also be used if a resistor $R_c$ is connected from the upper terminal of $R_{b5}$ to ground, without need for additional diodes $D_b$ because the Zener diodes $Z_1$ . . $Z_5$ will also conduct as normal diodes.) For example, Zener voltages are 180 Volts and currents 2 mA; $R_a = 1.5\ k\Omega$, $R_b = 2 \ldots 5\ k\Omega$. The load resistors $R_{a1}$ . . $R_{a5}$ are between the amplifier input switch $S_1$ and a grounding switch $S_o$; thus they have the same positions as the resistors $R_a'$ in the circuit of FIG. 12. Capacitors $C_{b1}$ . . $C_{b5}$ may be small ($C_b = 10 \ldots 100\ pF$) and may be alternatively arranged between the contacts of switch $S_2$. If there are no capacitors $C_z$ parallel to the Zeners (e.g. 0.5 $\mu$F, not shown) they could also be larger and act as filters together with the resistors $R_b$ to suppress the Zener noise voltages. High-ohmic discharge resistors $R_{z1} \ldots R_{z5}$ have no effect on the voltage distribution. Resistors $R_d$ and switch $S_4$ have been omitted for easier construction but could also be incorporated. As to the first case, the supply voltages $-U_b$ and $+U_c$ should be current regulated, or resistors $R_d'$ and $R_c'$ (the latter one is not shown) should be sufficiently large.

The feedback voltage is applied from the output of the amplifier OP to the dynode voltage divider via switch $S_2$ and a resistor $R_4$. As a main difference from the previous circuits, a more efficient feedback voltage can be obtained if, e.g., the resistor $R_1 = 3 \ldots 5R_a$. The effective load resistance at the last active dynode is given as $R_aR_1/(R_a + R_1)$ referred to which the current-to-voltage transducer circuit gives an output signal which is $(R_a + R_1)/R_a$ times larger. Non-linearities will be compensated for by adjusting the resistor $R_4$. An individual adjustment for each dynode position can also be obtained by adjusting the relevant resistors $R_b$ between zero and maximum value, or by providing individual resistors $R_4$ behind the switch $S_2$. For a change in gain of 1%, a voltage change of the order of 2 Volts is needed, which mainly contributes to the voltage at the last active dynode stage whereas the voltages across the other stages will be little affected. The compensation will be especially important where small differential signals are to be measured, such as in transient spectrophotometers. This may be seen from a series-development of the signal current I where $I_o$ is the ideal undistorted signal:

$$I = I_o - aI_o^2 - bI_o^3 - \tag{17}$$

$$\Delta I = \frac{dI}{dI_o} \cdot \Delta I_o = (1 - 2aI_o - 3bI_o^2 - \ldots) \cdot \Delta I_o \tag{18}$$

Thus, if the quadratic error term is dominant (finite $a$ but $b \simeq 0$) an error of, e.g., 4% in I will yield an error of 8 % in the differential signal $\Delta I$. A cubic error term (finite $b$ but $a \simeq 0$) would result in an error of $\Delta I$ of 12%. A feedback voltage of the order of 8 Volts will be needed for correction. For compensating a quadratic error an ohmic resistor $R_4$ is appropriate. A cubic error may be reduced by a factor of about 3. For more precise correction of cubic and even higher power terms, the resistor $R_4$ may be a non-linear one or series-connected with a non-linear network. Obviously, a non-linear network could also be provided with the feedback resistor $R_1$ of the amplifier OP. However, correction via the dynodes results in a smoother correction, can be easier handled and individually adjusted.

As already mentioned, fast circuits need a higher signal current and a more expensive amplifier than slower circuits but yield less performance in the longer time ranges. Similar to FIG. 9 where stock-keeping is simplified by using adaptors, the device of FIG. 13 is highly suited to overcome this problem and to fit various types of multipliers, too. The right-hand part of the circuit, together with current regulators for the supply lines $-U_B$ and $+U_c$, is constructed as a basic unit. Resistors $R_{a1} \ldots R_{a5}$, $R_1$, and $R_4$, switch $S_1$, the amplifier OP and a plug-in socket for the phototube PM are mounted on a plug-in circuit board and fixed by screws. Switch $S_1$ will be aligned to the other switches and have the same axis. As to the amplifier, a plug-in type may be used, too. The total range of risetimes, e.g. from 3 to 300 nsec and more, will then be covered by a set of plug-in cards. Specially designed circuits will be easily assembled, too. Non-linearity compensation is adjusted by the resistors $R_{b1} \ldots R_{b5}$ for the individual dynode ranges and by the resistor $R_4$ for the relevant current range.

PROTECTION MEASURES WHEN SWITCHING THE DYNODES

In the case of the circuits shown in FIGS. 1 to 3 interrupting type switches $S_1$ through $S_4$ and protective elements $R_s$ and $D_s$ at the amplifier input as shown in FIGS. 2 will be sufficient for protection when switching the dynodes even without disconnecting the supply voltages $-U_B$ and $+U_c$. A protective resistor $R_s$ and diodes $D_s$ will also be used in the circuits designed for a reduced risetime (FIGS. 7 to 13). However, the electric charge stored in the capacitors $C_b$ could lead to a higher risk of damage, particularly if the resistor $R_s$ must have a smaller value with respect to the smaller risetime. Consequently, additional protective measures are necessary. The arrangements discussed below in items 1 to 5 can be applied to the circuits in FIGS. 8 to 13 either separately or combined. As to the circuit of FIG. 7, item 5 will mainly be applied.

1. In the simplest case the following measures will be useful. The switches $S_0$ and $S_1$ in FIGS. 8 to 13 and also the switch $S_3$ in FIGS. 11 to 13 should be of the interrupting type. The switches $S_2$ and $S_4$ are of the non-interrupting type. At the output of the operational amplifier efficient protective diodes are connected to the supply voltages of the amplifier. If there are no individual decoupling capacitors $C_c$ and $C_d$ connected to ground (as in FIG. 2), the resistors $R_c'$ and $R_d'$ now act as protective resistors in the leads to the supply voltages $+U_c$ and $-U_B$.

2. An improved protection against current peaks during switching can be obtained if auxiliary contacts for high-ohmic recharge of the capacitors $C_b$ are provided between the main contacts of the switches $S_0$ to $S_4$. Switches which have 24 contact positions and 6 or 8 stopping positions per 360° are especially suitable. Consequently, each main contact will be provided with two or three auxiliary contacts which are connected instantaneously only during switching.

Figure 12A:
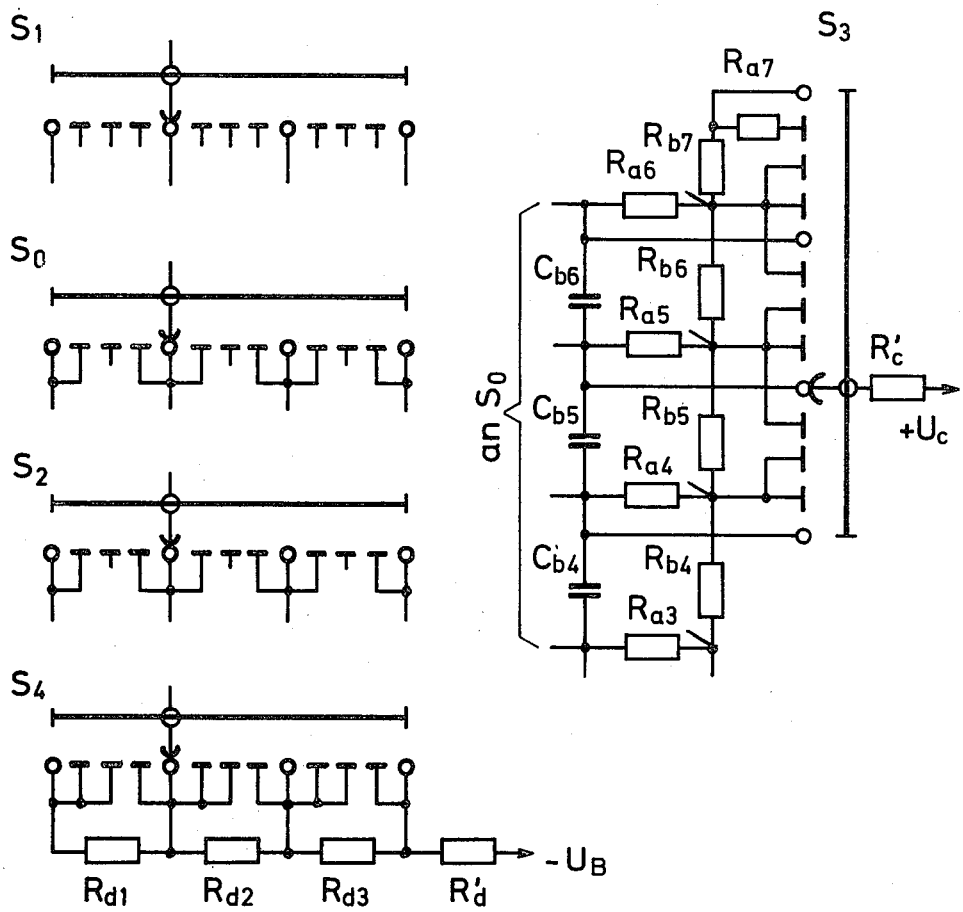
FIG. 12*a*: Improved version of switching device used in FIG. 12.

FIG. 12*a* shows a diagram of the switches $S_0 \ldots S_4$ corresponding to the device shown in FIG. 12, each with three auxiliary contacts. The sequence of the contacts, from left to right or from bottom to top, corresponds to FIG. 12. For switch $S_3$ the elements $C_{b4} \ldots C_{b6}$, $R_{b4} \ldots R_{b7}$, $R_c'$, $R_{a3} \ldots R_{a6}$ and an additional resistor $R_{a7}$ (e.g. equal to $R_a$) are also shown, as well as the resistors $R_{d1} \ldots R_{d3}$ and $R_d'$ for switch $S_4$. The main contacts of the switches have been drawn as circles and the auxiliary instantaneous contacts as dashes. The wipers of these switches are constructed so that the switches do not interrupt between directly adjacent contacts. As shown in FIG. 12*a*, the auxiliary contacts of the switch $S_1$ are not connected. Therefore, the switch S behaves as an interrupting switch making contact only at the stop positions. In the case of the switches $S_0$ and $S_2$ only the middle auxiliary contacts remain unconnected, the other auxiliary contacts are wired in pairs to the adjacent main contacts. These two switches interrupt also during switching, however they make contact for a longer period than the switch $S_1$. The switch $S_4$, of which the middle auxiliary contacts are also wired, works as a non-interrupting switch. The auxiliary contacts of $S_3$ are wired in pairs to the junctions of the dynode resistor chain, so that one of the resistors $R_{a4}$ . . $R_{a7}$ is situated between each main contact and the adjacent auxiliary contacts. The switch $S_3$ thus makes a non-interrupting switch provided with recharging resistors for the recharge of the capacitors $C_{b4}$ . . $C_{b6}$ during continued switching. (In FIG. 11, the resistors $R_{a4}$ . . $R_{a7}$ in series with the resistors $R_{a4}'$ . . $R_{a7}'$ would act as charging resistors.) Consequently, for a resistance ratio of e.g. $R_b/R_a = 3$, the recharge currents are limited to three times the dynode chain current. In practice, no special auxiliary contacts are required for the switches $S_0$, $S_1$, $S_2$, and $S_4$ if these switches are provided with contact studs of different width in order to obtain long ($S_0$), short ($S_1$,$S_2$) or no ($S_4$) interrupting intervals. In the case of switch $S_3$ two auxiliary contacts are needed between the main contacts connected to the junctions of the dynode resistor chain as described above.

3. Unfavourable current peaks during switching can be completely avoided if, in addition to items 1 and 2, a current limiting network is inserted in the lead to the positive supply voltage $+U_c$ which gives a low dynamic source resistance in the operating current range but acts as a current source when the current exceeds an upper limit. (Conventional overload protection circuits used in power supplies will have too large time constants mostly, but function is similar.) Suitable networks using high voltage transistors $T_c$ are shown in FIGS. 14*a* and *b*. FIG. 14*a* represents a three-terminal network which is connected to an increased supply voltage $U_{c0} = U_c \cdot (R_{c2}+R_{c3})/R_{c3}$. In the operating current range the source resistance at the junction $+U_c$ is mainly due to the emitter series resistance $R_{c1}$ (e.g. 100 Ω). When the operating current is exceeded the two diodes connected in series become conducting. Thus the base-emitter voltage and the collector current of the transistor $T_c$ are stabilized.

As an alternative, FIG. 14*b* shows a two-terminal network in which the transistor $T_c$ is inserted in a bridge circuit consisting of current limiting resistor $R_{c1}$ (e.g. 100 Ω) and $R_{c2}$ (e.g. 30 *k*Ω) and voltage limiting diodes $2 \times D_{c1}$ and $Z_c$ (e.g. a 6V-Zener diode). A reverse-current blocking diode $D_{c2}$ may be necessary if the time constant $R_b \cdot C_b$ of the dynode resistor chain exceeds the several milliseconds. The current-to-voltage characteristics of this circuit are shown in FIG. 14*c*. In the operating current range $J_{cl} < J_c < J_{c2}$ the transistor is switched through. The dynamic resistance of the network results from the emitter series resistor $R_{c1}$ in series with the switching-through resistance of the transistor and the dynamic resistance of the Zener diode $Z_c$ and the diode $D_{c2}$; the voltage drop $\Delta U_c = U_{c0} - U_c$ is almost equal to $U_z$. In the range above or below, the dynamic resistance is mainly determined by the resistor $R_{c2}$. A source resistance ratio larger than 50:1 can easily be obtained.

4. At high dynode chain currents a two-terminal network similar to FIG. 14*b* can also be inserted in the lead to the negative voltage source $-U_B$. As shown in FIG. 14*d* two or more high voltage transistors $T_B$ can be connected in series. The circuit elements correspond to those in FIG. 14*b* but have index B instead of index *c*.

5. A different protective measure is to switch off the supply voltages $-U_B$ and $+U_c$ via an auxiliary switch which, at applied voltages, locks the switches $S_0$ to $S_4$ mechanically. FIG. 15 shows an especially convenient locking device the principle of which is known in another context. The switches $S_0$ . . $S_4$ have a knob P with a dial Q into the openings of which a toggle switch $S_N$ fits. The knob P can be rotated only if the toggle switch $S_N$ is in the "off" position. To avoid direct switching of the high voltages the power supply should have a remote control circuit to which the switch $S_N$ is connected. However, it is also satisfactory if the power supply has an overload protection circuit with a reset switch, to secure that the voltages $-U_B$ and $+U_c$ are switched off together. The overload protection circuit may then be released by the switch $S_N$ by switching an overloading resistor to the voltage source $+U_c$. For sake of improved safety, the switch $S_N$ may actuate a remote control line of the power supply in its on-position and switch an overloading resistor in its off-position.

MECHANICAL LAY-OUT OF CIRCUIT DEVICE AND PHOTOMULTIPLIER HOUSING

The switching device comprising the switches $S_0$, $S_1$ . . $S_4$ and the electronic circuit elements should be arranged very close to the photomultiplier socket in order to secure minimum stray capacitances and thus a minimum risetime $\tau_D$. This is facilitated by the low heat dissipation of the dynode chain elements. Especially, the multiplier load resistors should be wired directly to the switch connections. The same holds also for the resistors $R_b$, $R_d$, the diodes $D_b$, Zeners such as $Z_1$, and the capacitors $C_b$ if there is enough space or if the switching device has additional supporting planes. This minimizes wire length and gives the best possible insulation. Operational amplifiers and further circuit elements are arranged on a small printed circuit board close to the switching device.

In the case the circuits devices are not integrated into larger constructional units, they can easily be constructed as individual units. This is especially favourable for assembling commercial instruments in the block-building technique and for experimental sets used in laboratories. A preferred mechanical version uses a cylindrical housing with an end-on or side-on window for the entry of light.

Figure 16:
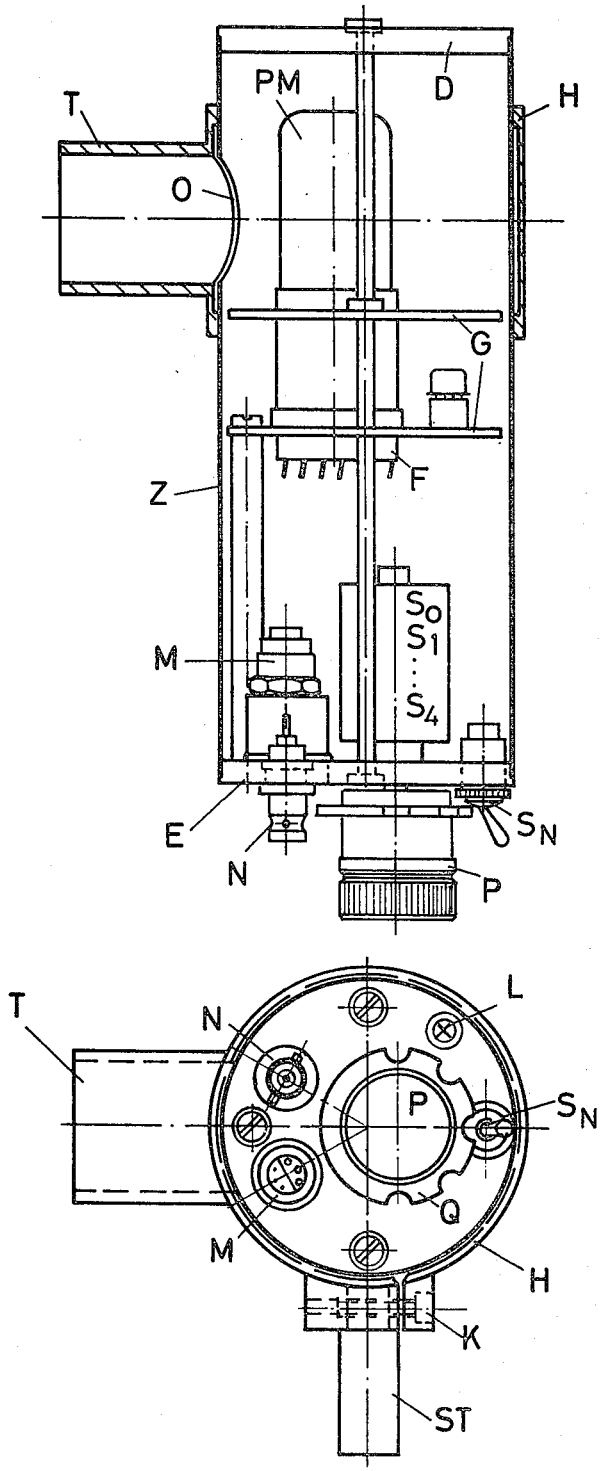
FIG. 16: Photomultiplier housing for side-on phototubes used in circuits according to FIGs. 2 and 7 through 15.

FIG. 16 shows a housing for photomultipliers with side-on windows. The following parts are arranged on the back E of the housing: dynode switches $S_0$, $S_1$ . . $S_4$ with knob P and dial Q, protection switch $S_N$ and overload indicator L, connectors M and N for power supply M and signal output N. The output signal may also be fed via the multi-lead connector M. A socket F for the multiplier tube PM and one or two printed circuit boards G are mounted on supporting rods close to the switches $S_0$, $S_1$ . . $S_4$. By means of a taut clamping device K, the cylindrical metal housing Z with an entrance window *O* is inserted into a holder H on which a light protection tube T is mounted. A supporting rod ST can be screwed either into the clamping device K or into the cover plate D. thus allowing a vertical or a horizontal mounting of the housing on an optical bench. If the clamping device is released, axial and lateral movements of the housing for optimal adjustment of the photocathode onto the light beam are possible. According to the upper drawing of FIG. 16, the cylindrical part of the holder H is relieved on its inner side so that only the edges contact the housing Z. The space inbetween is lined with a layer of black felt. Thus perfect optical sealing and perfect electrical contact are obtained. The tube T serves also as an electrical shield to the entrance window O, working as a wave-guide below the cut-off frequency. An additional magnetic shield for the multiplier tube PM is used as usually, but it is not shown. This shield is DC-connected to the cathode potential via a high-ohmic resistor and AC-connected to ground via a blocking capacitor. The housing shown in FIG. 16 is also useful for installation of other photomultiplier devices where provisions are made for switching the signal gain, e.g. by switching an anode load resistor, and is claimed independently.

Similar housings with a simpler holder are used for photomultipliers with front-on windows, e.g. in the circuits according to FIG. 3. Such "photomultiplier heads" are only little larger than the conventional photomultiplier housings. However, they are definitely superior with respect to the field of application and the ease of operation. The combination of an incorporated amplifier with a dynode switching device makes optimal use both of the amplifier and of the dynode switching circuit. Contrary to circuits where a load resistor is switched, the risetime of the output signal is independent both of the selected signal gain and of the capacitance of signal cables.

What is claimed is:

1. Circuit device for a multi-stage secondary electron multiplier, said multiplier having a source of primary electrons, a number of successive dynodes, and at least one electron collecting electrode as an anode, said circuit further comprising a voltage divider having a lower and an upper end terminal and successive taps, said divider comprising serially connected impedance means, said lower terminal being coupled to a negative supply voltage, said upper terminal being held at an essentially non-negative potential, said dynodes being coupled to said taps, the first dynode being the lowest one, said circuit further comprising signal coupling means which comprise at least one load resistor and an amplifier coupled to a signal output terminal and operating near reference zero potential, and gain switching means, wherein at least two of said dynodes have individual load resistors, said load resistors being interconnected between said dynodes and said taps, said switching means comprising at least two series of fixed contacts connected to said dynodes and said taps, respectively, and at least three ganged movable contacts for changing the number of activated dynode stages, the first and the second one of said movable contacts connecting one selected dynodes and one corresponding tap to said amplifier, said selected dynode operating as the last active dynode, the third of said movable contacts coupling the dynode succeeding to said selected dynode to a positive drain voltage, said succeeding dynode operating as an effective anode.

2. The circuit as claimed in claim 1 wherein said amplifier and said load resistor of said selected dynode form a current-to-voltage transducer, said amplifier being an inverting operational amplifier, said first and second movable contact connecting input and output of said amplifier to said selected dynode and said corresponding tap, respectively, said amplifier effecting a negative feedback to said voltage divider.

3. The circuit as claimed in claim 2 wherein said voltage divider means are series-connected and essentially equal divider resistors, said load resistors being essentially equal, the resistance ratio of said divider resistors and said load resistors being not smaller than unity and not larger than the gain factor per dynode stage of said multiplier at a preselected operating voltage per dynode stage.

4. The circuit as claimed in claim 3 wherein said resistance ratio is approximately equal to: $v + 1/v - 2$, wherein $v$ is the gain factor.

5. The circuit as claimed in claim 4 wherein said source of primary electrons is a photocathode coupled to said lower terminal, said resistance ratio not applying to the lowest section of said voltage divider corresponding to the first dynode stage of said multiplier, the divider resistor of this section being at least partly replaced by a Zener diode.

6. The circuit as claimed in claim 1 wherein the operating voltages across the majority of said activated dynode stages, measured between two successive taps of said voltage divider, are essentially equal, said drain voltage being at least of the same size as said operating voltages.

7. The circuit as claimed in claim 6 further comprising means coupling at least two dynodes succeeding to said selected dynode to said drain voltage.

8. The circuit as claimed in claim 7 wherein rectifier diodes are connected between adjacent taps of said voltage divider, the cathodes and anodes of said diodes being directed towards said upper and lower terminal, respectively, and further comprising a biasing resistor interconnected between the cathode of the upper most of said diodes and reference zero potential.

9. The circuit as claimed in claim 7 wherein said third movable contact is supplemented by a series of succeeding movable contacts forming a summing-type switch and coupling said succeeding dynodes to said drain voltage.

10. The circuit as claimed in claim 1 wherein said source of primary electrons is a photocathode coupled to said lower terminal of said voltage divider, further comprising a load resistor interconnected between said cathode and said lower terminal, said cathode and said lower terminal being connected to said first and said second set of contacts, respectively, in order to select also said photocathode in place of a selected dynode and to operate said multiplier as a photodiode.

11. The circuit as claimed in claim 1, further comprising means which provide a current flow through said voltage divider to the terminal of said negative supply voltage which is essentially independent on said number of activated dynode stages.

12. The circuit as claimed in claim 11 comprising a series of dropping resistors are serially interconnected between said lower terminal of said voltage divider and said negative supply terminal, said switching means further comprising a set of fixed contacts connected to said dropping resistors and another ganged movable contact shunting part of said dropping resistors.

13. The circuit as claimed in claim 12, said circuit further comprising means for selectively increasing the operating voltage of the first dynode stage of said multiplier when switching to the lowest number of activated dynode stages, said means comprising: the lowest section of said voltage divider corresponding to said first dynode stage having an auxiliary terminal connected to said other movable contact, said section being formed as a triangular network and having a diode connected with its anode and cathode to said lower and said auxiliary terminal, respectively.

14. The circuit as claimed in claim 2 wherein the most positive dynode selectable by said switching means has no individual tap and no feedback to said voltage divider but means for switching its load resistor, said means comprising: said dynode being connected to said first set of contacts and coupled to serially connected load resistors, said load resistors increasing from the load resistor connected to said dynode to the load resistor farthest apart from said dynode, the effective load resistance being selected and coupled to said output of said amplifier by said second movable contact and by fixed contacts which are in-line with said second set of contacts.

15. The circuit as claimed in claim 14 wherein two diodes are coupled across at least one of said serially connected load resistors, said diodes being serially connected with rectifier diodes coupled across said taps of said voltage divider and becoming conductive upon decreasing said number of activated dynode stages.

16. The circuit as claimed in claim 1 wherein said source of primary electrons is a photocathode, further comprising a current limiting resistor interconnected into the lead of said photocathode, and means including a clamping diode connected to said cathode and a diode biasing circuit, said means effecting a constant voltage drop across said current limiting resistor as long as said photocathode is operated within its normal current range.

17. Circuit device for a multi-stage secondary electron multiplier, said multiplier having a source of primary electrons, successive dynodes, and anode, said circuit further comprising a voltage divider having a lower end terminal coupled to a negative supply voltage, an upper end terminal held at an essentially non-negative potential, and successive taps coupled to said dynodes, the first dynode being the lowest one, said voltage divider comprising essentially equal divider resistors up from the tap coupled to said first dynode, said circuit further comprising switching means for switching the number of activated dynode stages, at least one load resistor with any switchable dynode coupled to said voltage divider, and an amplifier having an input and at least one output and operating near reference zero potential, said switching means comprising at least two sets of fixed contacts, the first and the second one of said sets connected to said dynodes and said taps, respectively, and at least three ganged movable contacts, the first and the second one of said movable contacts connecting one selected dynode and one corresponding tap to said input and output of said amplifier, respectively, said selected dynode operating as the last active dynode, said amplifier effecting a feedback to said voltage divider, the third of said movable contacts coupling the dynode succeeding to said selected dynode to a positive drain voltage, said succeeding dynode operating as an anode, wherein said switchable dynodes have first and second load resistors, the resistance ratio of said divider resistors and said first load resistors being not smaller than unity and not larger than the gain factor per dynode stage of said multiplier, said second load resistors being smaller as said first load resistors, said first and second load resistors having first and second terminals, said first and second terminals of said first load resistors being coupled to said dynodes and connected to the corresponding taps of said voltage divider, respectively, said first and second terminals of said second load resistors being connected to said dynodes and to a series of capacitors, said series of capacitors being coupled to said reference potential.

18. The circuit as claimed in claim 17 wherein said capacitors are serially connected, further comprising at least one set of fixed contacts connected to said second terminals of said second load resistors and an auxiliary movable contact ganged with said switching device, said auxiliary movable contact connecting the second terminal of the second load resistor of said selected dynode to said reference potential, said third movable contact connecting the second load resistor of said succeeding dynode to said drain voltage, and rectifier diodes connected across said capacitors, the cathodes and anodes of said diodes being directed towards the upper and lower dynodes, respectively, a biasing resistor interconnected between the cathode of the upper most of said diodes and said reference potential.

19. The circuit as claimed in claim 17 wherein said first terminals of said first and second load resistors are jointly connected to said dynodes.

20. The circuit as claimed in claim 18 wherein said first terminals of said first load resistors are connected to said second terminals of said second resistors and that a further resistor is interconnected between said first and second movable contact; said further resistor having essentially the same value as said first load resistors.

21. The circuit as claimed in claim 17 wherein said second load resistors and said capacitors are mounted in an adapter unit having a connector fitting into a multi-lead socket, further having a socket accepting said multiplier.

22. The circuit as claimed in claim 21 wherein said adapter unit comprises a switch ganged with said switching device when said connector is in its operational position within said multi-lead socket.

23. The circuit as claimed in claim 17 wherein the output of said amplifier connected to said second movable contact has a predetermined signal rise time; and each of said secon load resistors forms, together with the associated capacity of said capacitors, a time constant which is not smaller and not more than 20 times larger than said signal rise time.

24. The circuit as claimed in claim 17 wherein said amplifier comprises a first and a second amplifier unit having first and second output, respectively, said first output coupling a signal to a signal output terminal, said second amplifier unit having a larger gain factor and a larger risetime constant than said first unit, said second output coupling a feedback signal to said voltage divider.

25. The circuit as claimed in claim 24 comprising two serially coupled operational amplifier units, the input of the first one being connected to said first movable contact, further being coupled to said first output by a feedback resistor, the second one having non-inverting and inverting input, said non-inverting input coupled to said first output, said inverting input coupled to said second output by a divider network, the DC-division ratio of said network corresponding to the resistance ratio of said feedback resistor to said first load resistors.

26. The circuit as claimed in claim 25 having RC-networks connected with said non-inverting and inverting inputs, further comprising a capacitor serially connected with said feedback resistor, both forming a time constant which is essentially equal to the time constants of said RC-networks.

27. The circuit as claimed in claim 24 using a fast differential amplifier and a slower operational amplifier for said first and second amplifier units, said fast amplifier having first and second input, said first input and the input of said operational amplifier being coupled to said first movable contact, further comprising a divider network connected between said second output and said second input, the division ratio of said network being equal to the reciprocal resistance ratio of said first and second load resistors.

28. The circuit as claimed in claim 1 wherein a series of capacitors is connected to said dynodes, said capacitors being connected to said reference potential by a complementary summing-type switch ganged to said switching device, said complementary switch disengaging the capacitor connected to said selected dynode.

29. The circuit as claimed in claim 1 wherein each set of contacts of said switching device comprises at least one movable contact and a number of stationary contacts, and that said movable and stationary contacts are formed and positioned such that, when switching, at least said second movable contact breaks after and closes before said first movable contact breaks and closes, respectively.

30. The circuit as claimed in claim 18 wherein each set of contacts of said switching device comprises at least one movable contact and a number of stationary contacts, and that said movable and stationary contacts are formed and positioned such that, when switching, said first movable contact breaks before and closes after said second and said auxiliary movable contacts break and close, respectively, said third movable contact touching intermediate contacts arranged between said stationary contacts, said intermediate contacts being positioned and connected such that said capacitors are discharged via a high-impedance discharge path.

31. The circuit as claimed in claim 17, further comprising current limiting means in at least one lead of said supply and drain voltages.

32. The circuit as claimed in claim 31, wherein said current limiting means is formed by a two-terminal bridge circuit having at least four arms, comprising in opposite arms resistors and voltage limiting diodes, respectively, and at least one high-voltage transistor in the center part.

33. The circuit as claimed in claim 1 said switching device further comprising locking means including an auxiliary switch controlling said supply and drain voltages, said locking means releasing said switching device only if said voltages are switched off.

34. The circuit device as claimed in claim 1 wherein said amplifier is provided with overload indicating means.

35. The circuit as claimed in claim 1 wherein said switching device and other components forming said circuit are arranged adjacent a plug-in socket of said multiplier, said load resistors and means forming said divider being attached in a zigzag-fashion to the terminals of said switching device.

36. The circuit as claimed in claim 1 wherein said multiplier, said switching device and electronic components forming said circuit are housed in a metal housing, having a multi-lead connector for operating said circuit, and forming a self-contained unit.

* * * * *